US012790900B2

(12) United States Patent
Borissov et al.

(10) Patent No.: US 12,790,900 B2
(45) Date of Patent: Nov. 10, 2026

(54) HYDROJETS ROTARY DRILL BIT WITH VOLUMETRIC COOLING

(71) Applicant: Cool Edge Bits, Inc., Houston, TX (US)

(72) Inventors: Anatoli Alimpievich Borissov, Sugarland, TX (US); Vasili Borissov, Richmond, TX (US); Alexandre Borissov, Calgary (CA)

(73) Assignee: Cool Edge Bits, Inc., Houston, TX (US)

( * ) Notice: Subject to any disclaimer, the term of this patent is extended or adjusted under 35 U.S.C. 154(b) by 14 days.

(21) Appl. No.: 19/037,187

(22) Filed: Jan. 25, 2025

(65) Prior Publication Data

US 2026/0117596 A1 Apr. 30, 2026

(51) Int. Cl.

| | |
|---|---|
| ***E21B 10/61*** | (2006.01) |
| ***E21B 4/02*** | (2006.01) |
| ***E21B 10/60*** | (2006.01) |
| ***E21B 36/00*** | (2006.01) |

(52) U.S. Cl.
CPC ..... *E21B 10/61* (2013.01); *E21B 4/02* (2013.01); *E21B 10/602* (2013.01); *E21B 36/001* (2013.01)

(58) Field of Classification Search
CPC ..... E21B 10/61; E21B 10/60
See application file for complete search history.

(56) References Cited

U.S. PATENT DOCUMENTS

| | | | | |
|---|---|---|---|---|
| 3,645,346 | A * | 2/1972 | Miller | E21B 10/60 175/231 |
| 4,452,324 | A * | 6/1984 | Jurgens | E21B 10/602 299/81.3 |
| 4,606,418 | A * | 8/1986 | Thompson | E21B 10/61 175/339 |
| 4,794,994 | A * | 1/1989 | Deane | E21B 10/43 175/429 |
| 4,848,489 | A * | 7/1989 | Deane | E21B 10/43 175/429 |
| 4,989,680 | A | 2/1991 | Deane et al. | |
| 10,337,257 | B2 * | 7/2019 | Zhang | E21B 10/43 |
| 11,988,046 | B1 * | 5/2024 | Borissov | E21B 10/602 |
| 2010/0018771 | A1 * | 1/2010 | Borissov | E21B 10/60 175/57 |

(Continued)

FOREIGN PATENT DOCUMENTS

| | | | | |
|---|---|---|---|---|
| CN | 114645676 | A * | 6/2022 | E21B 10/43 |

OTHER PUBLICATIONS

Machine translation of CN 114645676 A (Year: 2022).*
Copy and machine translation of CN 114645676 (Year: 2022).*
Machine translation of CN 114645676 (Year: 2022).*

*Primary Examiner* — Blake Michener
(74) *Attorney, Agent, or Firm* — PatentPC; Bao Tran

(57) ABSTRACT

A method for drilling with a drill bit includes communicating a fluid from a bottom hole assembly to a center of the bit; directing the fluid through at least one peripheral port or nozzle whose axis does not intersect with a surface of a bore of the drill bit; distributing the fluid through ports or nozzles coupled to a plurality of blades and junk slot areas distributed circumferentially around a center axis; and directing fluid with a plurality of ports or nozzles to the cutting elements for cleaning and cooling.

17 Claims, 13 Drawing Sheets

(56) References Cited

U.S. PATENT DOCUMENTS

| | | | | |
|---|---|---|---|---|
| 2010/0276206 | A1* | 11/2010 | Borissov | E21B 10/602 76/108.1 |
| 2018/0002986 | A1* | 1/2018 | Zhang | E21B 10/43 |
| 2022/0389765 | A1* | 12/2022 | Morin | E21B 10/14 |
| 2023/0212944 | A1 | 7/2023 | Bhome et al. | |

* cited by examiner

HYDROJETS ROTARY DRILL BIT WITH VOLUMETRIC COOLING

FIELD OF THE INVENTION

The present invention relates to a rotary drill bit.

BACKGROUND OF THE INVENTION

Rate of penetration (ROP) of the drill bit is a major characteristic for wells, and often a critical cost issue for deep wells. Low ROP in the order of 3-5 feet per hour is commonly the result of the high compression strength of formations encountered at the greater depths, and the ineffectiveness of the cutting bit. Another important characteristic is the number of trips per well, which deal with the number of drill bits used in the drilling well.

In a conventional drill bit, the fluid (mud) flows from one or several nozzles for clearing and cooling the cutters. The mud jet is commonly directed straight from the nozzle to the base of drilling bore (dome). Such flow of the mud causes numerous disadvantages. First, the jet entrains the drill cuttings or solids and brings them to the bottom of borehole. Then drill cuttings go back up to passing the drill bit cutters, and after particle regrinding they erode the bit's surface and cutters edges. Another disadvantage is that heat is not appropriately transferred from the bit's cutter to the mud, due to lower speed of the mud flow through the debris slots in the bit. This causes a large heat stress on the cutters thus reducing their rigidity, increasing wearing and dulling which in turn reduces the rate of penetration and the operating hours for the drill bit.

U.S. Pat. No. 6,142,248 to Thigpen et al. discloses a method to reduce nozzle erosion using a nozzle which supplies the mud in the laminar flow regime. An enhanced hydraulic design (Mudpick II) plays a key role in the roller cone drill bit performance. The mud stream is directed first to clean the cutters and then it sweeps under a cutter at the point of formation contact for efficient chip removal.

The jet path from the nozzle expands and meets the cutters on a roller cone, which commonly are not in contact with the formation. The jet dissipates and loses hydraulic energy and does not provide the desired efficiency.

U.S. Pat. No. 8,100,201 to Borissov disclosed a method to improve the heat rejection from the cutters and reduce their temperature to increase the rigidity of the cutters. The method works very well. However, the hydraulic path in this invention does include the volumetric channel design and does not use all advantages of the regarding cooling and heat rejection of the inside of the bit body, plenum and channels.

SUMMARY OF THE INVENTION

In first aspect, a method for drilling with a drill bit includes communicating a fluid from a bottom hole assembly to a center of the bit; directing the fluid through at least one peripheral port or nozzle whose axis does not intersect with a surface of a bore of the drill bit; distributing the fluid through ports or nozzles coupled to a plurality of blades and junk slot areas distributed circumferentially around a center axis; and directing fluid with a plurality of ports or nozzles to the cutting elements for cleaning and cooling.

In a second aspect, a rotary drill bit for drilling a hole in a subsurface formation includes a bit body made of steel or matrix having a leading cutting face and outer peripheral edges, the bit body including a plurality of radially extending blades with a flow channel between adjacent blades, the bit body further including a bit body flow path radially inward of the peripheral edges; a plurality of cutting elements each fixedly mounted on a respective one of the plurality of radially extending blades; a plurality of flow nozzles in fluid communication with the bit body flow path for creation and directing high speed fluid jets directed to a respective one of the plurality of cutting elements to clean and cool the cutting element, wherein the fluid flow is outputting tangentially to the circumference of bit body through a plurality of flow nozzles to the respective plurality of cutting elements mounted on a respective neighboring blade.

In a third aspect, a rotary drill bit is provided for drilling a hole in a subsurface formation. The drill bit includes a bit body having a leading cutting face and outer peripheral edges. The bit body also includes a plurality of radially extending blades with a flow channel (slots for cuttings removal) between adjacent blades and includes a bit body flow path radially inward of the peripheral edges. A plurality of cutting elements are each fixedly mounted on a respective one of the plurality of radially extending blades. A plurality of flow nozzles are made on each blade with special conical interior profile of the nozzle. Each flow nozzle is in fluid communication with a bit body flow path to direct fluid to a respective one of the plurality of cutting elements to clean and cool the cutting element.

In a fourth aspect, a rotary drill bit for subsurface formation drilling includes multiple blades arranged around a central axis and possesses a bore that delivers hydraulic fluid from the bottom hole assembly to the bit's center. Uniquely, at least one of the peripheral hydraulic bore exits is arranged so that its axis does not intersect with the bit's bore surface. The bit body is constructed with several radially extending blades, each having a flow channel for fluid transfer between blades.

In a fifth aspect, an apparatus features a number of blades arranged around a central axis, with an bore for transporting hydraulic fluid from the bottom hole assembly to the center of the bit, and includes a peripheral curved or angled channel which does not intersect with the bore surface. The bit body is equipped with a leading cutting face, peripheral edges, and radial blades that create flow channels. Cutting elements are mounted on the blades, and multiple nozzles are designed to dispense fluid over the cutting elements to assist in their cleaning and cooling.

In designs, the channels are angled or curved channels which allow an increase in retention time during the delivery of the water/mudflow/drilling fluids/loss circulation material for these fluids to provide heat rejection from the inner geometry of drill bit body, channels and plenum. By providing hard wearing material sleeves for these curved/angled channels the system also prevents erosion during this process.

Advantages of the above designs may include one or more of the following. The present invention relates to improvements in drill bits which result in improved rate of penetration (ROP), increased working hours, and reduced requirements for the cutters. The present invention provides a significantly improved hydraulic system which manages the fresh fluid flow to each tooth of the drill bit. The operation of this downhole drill bit results in reduced thermal stresses at the cutter by an individual jet cooling each tooth, improved cleaning capability by supplying fresh fluid to the cutter, and reduced erosion of the cutters. Other advantages may also include:

Improved Cuttings Removal Efficiency: The drilling fluid is more effectively directed onto the cutting face. This targeted fluid delivery ensures that cuttings are more efficiently flushed from the drill face, enhancing the rate of penetration and promoting continuous drilling operations without frequent stops to clear debris.

Enhanced Cooling of Cutting Elements: Optimal distribution of hydraulic fluid over the cutting elements reduces the thermal load on these components. Effective cooling can prevent overheating, which is a common cause of premature wear and equipment failure. As a result, the cutting elements are less likely to degrade or fracture, extending their operational life.

Enhanced Cooling of the Drill Bit Body: The drill bit body head includes network of numerous coolant channels with high volume coolant fluid (mud) flow through. High volume flow through the body provides high heat rejection from the body material and increase bit rigidity and longevity especially for drilling in high temperature environment like for offshore and geothermal wells.

Increased Drilling Efficiency: By maintaining cleaner cutting elements and reducing the need for pullback and cleaning intervals, drilling operations can proceed more rapidly. This improves overall drilling efficiency, reducing the time and cost associated with drilling each well or borehole.

Better Fluid Distribution: The off-center positioning of the exit ports for hydraulic fluid encourages a more uniform distribution of fluid across the cutting face. This can lead to more consistent cooling and cleaning of the entire bit, rather than just certain areas, which is a limitation of traditional drill bit designs.

Enhanced Drill Bit Longevity: By ensuring the drill bit components are effectively cooled and cleaned, the overall life of the drill bit is extended. This means fewer replacements are needed, leading to a reduction in equipment costs over the life of a drilling project.

Reduced Non-Productive Time (NPT): By improving the rate of cuttings removal and cooling performance, the likelihood of bit balling, plugging, and other issues that can halt drilling operations is decreased. Therefore, NPT is reduced, leading to more efficient drilling campaigns.

Adaptability to Various Drilling Conditions: One implementation's design may be adaptable for customization to suit different subsurface formations and drilling conditions. The flexible fluid delivery system could be adjusted to provide the optimum flow rate, pressure, and stream pattern required for specific drilling environments.

Improved Drilling Fluid Management: The integrated fluid management system within the drill bit design could promote better utilization of drilling fluids, potentially allowing for less fluid consumption overall and reducing the environmental impact associated with fluid disposal.

These and further features and advantages of the present invention will become apparent from the following detailed description, wherein reference is made to the figures in the accompanying drawings.

DETAILED DESCRIPTION OF PREFERRED EMBODIMENTS

A hydrojets rotary drill bit with volumetric cooling is provided for drilling a hole in a subsurface formation. The drill bit includes a bore communicating hydraulic fluid from the bottom hole assembly to the center of the bit, with at least one peripheral curved or angled channel whose axis does not intersect with the surface of the bore of the bit.

In implementations, the bit body includes a plurality of axially extending blades and a flow channel between adjacent blades. The drill bit body head includes a network of numerous coolant channels with high volume coolant fluid (mud) flow through. High volume flow through the body provides high heat rejection from the body material and increase bit rigidity and longevity especially for drilling in high temperature environment like for offshore and geothermal wells. A plurality of cutting elements is fixedly mounting on a respective one of the plurality of blades. A plurality of flow nozzles made on respective one of the plurality of blades to direct fluid (mud) to a respective one of the plurality of cutting elements to clean and cool the cutting elements. The rotary drill bit includes a plurality of cutting elements each mounted on a respective one of a plurality of radially extending blades, and a plurality of flow nozzles, made on respective one of the plurality of blades, for directing fluid jets to a respective one of the cutting elements.

The improved drill bit provides improved rate of penetration (ROP), decreasing working hours, and reduced requirements for the cutters. This is done with a hydraulic system which manages the fresh fluid high speed jet flow through the fixed angled ports having interchangeable nozzles flowing out to each cutter of the drill bit. The operation of this downhole drill bit results in reduced thermal stresses at the cutter by an individual jet cooling each tooth, improved cleaning capability by supplying fresh fluid to the cutter, and reduced erosion of the cutters.

Figure 1A:
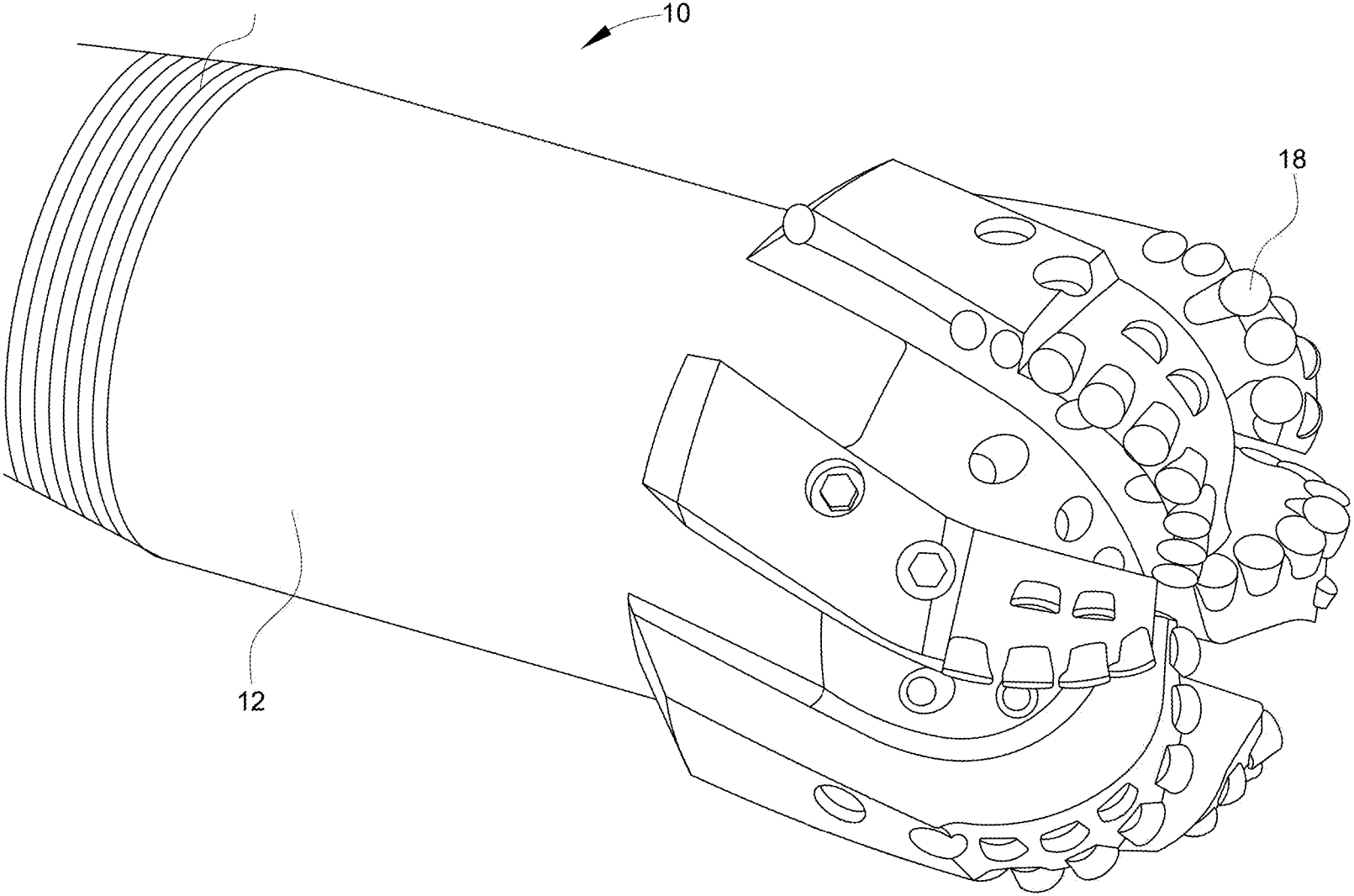
FIG. 1A-1B illustrate one embodiment of a rotary bit.
Figure 1B:
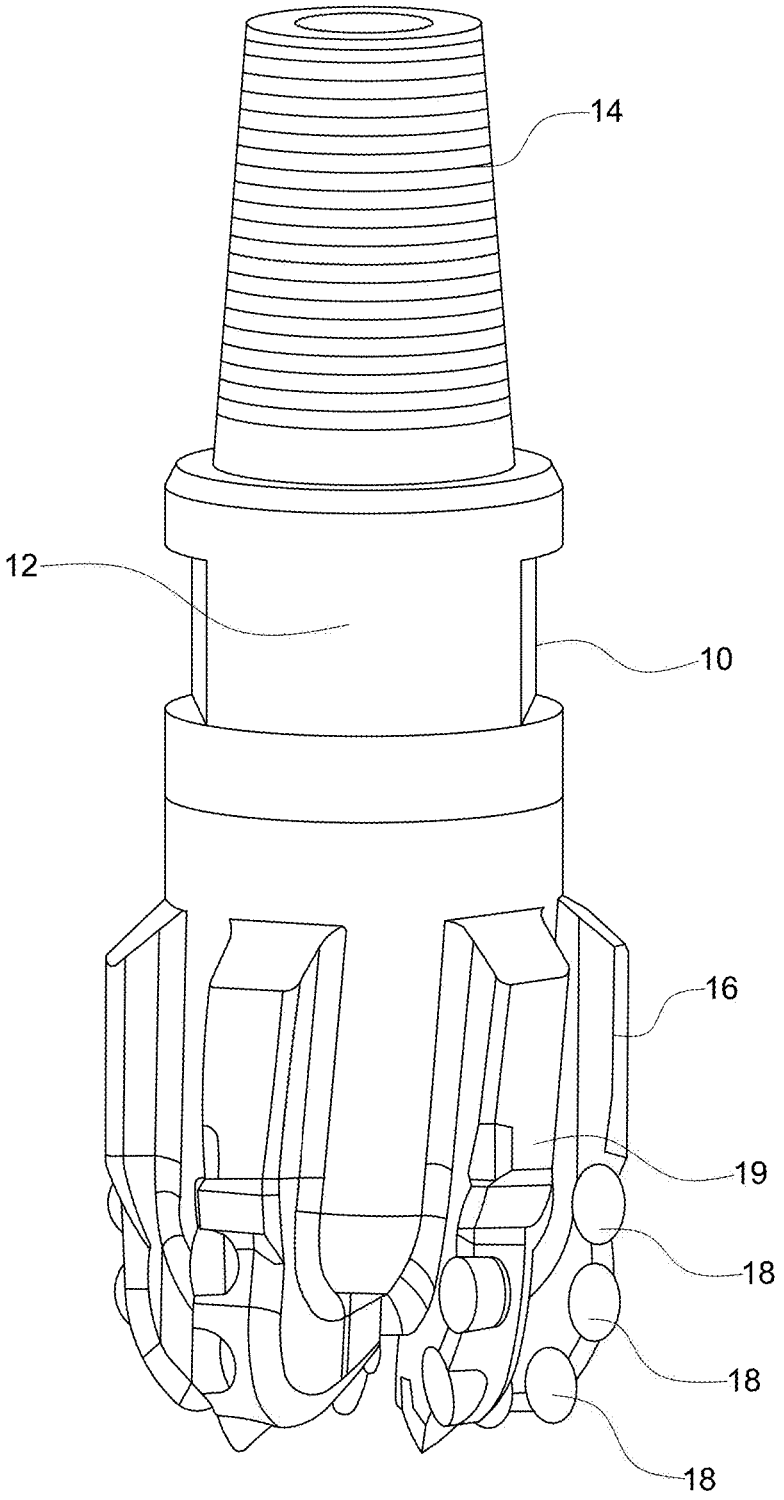
Figure 2:
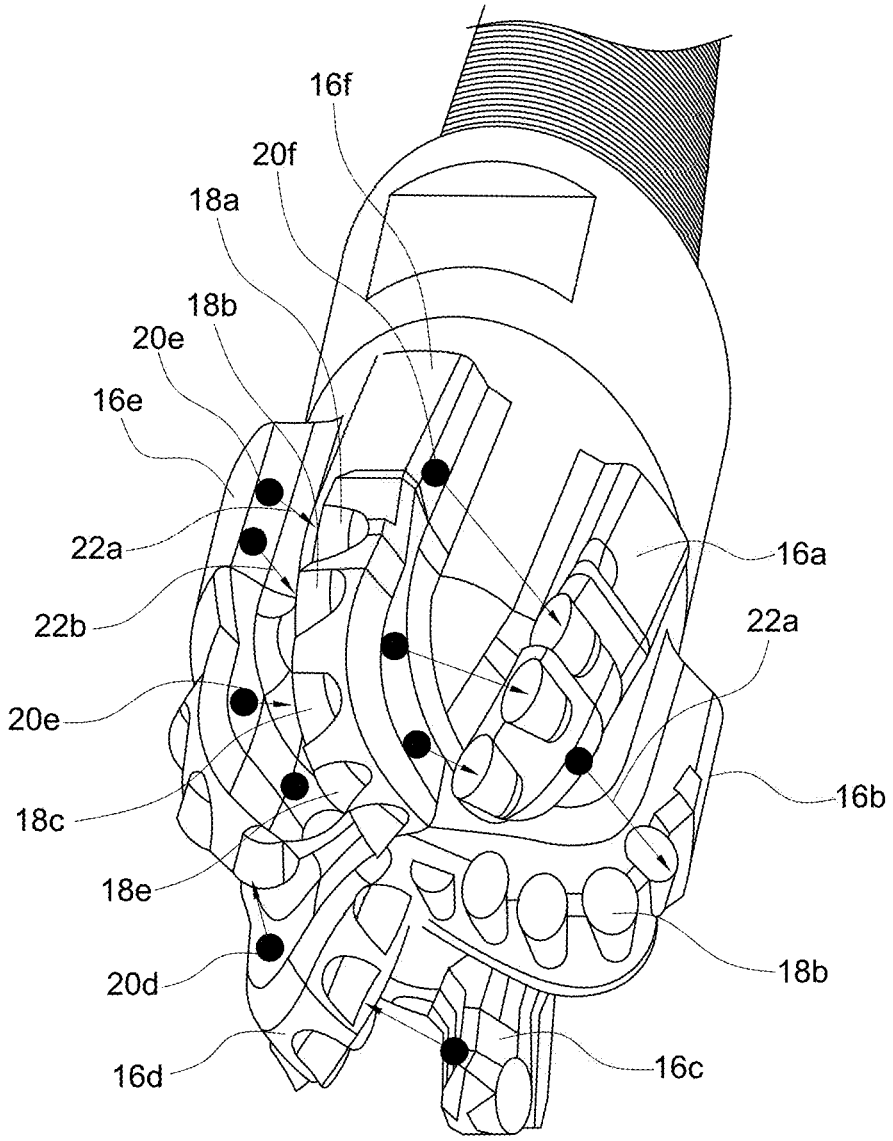
FIG. 2 is an isometric view of the drill bit shown in FIG. 1.

Referring now to FIG. 1A-1B, one embodiment of an improved rotary drill bit 10 is illustrated, comprising a bit body 12 with upper box threads 14 for interconnection with a drill pipe or other tubular. Those skilled in the art will appreciate that box threads 29 on FIG. 3 may be provided on the bit body rather than the pin threads. As shown in FIGS. 1 and 2, the drill bit includes six circumferentially spaced blades 16*a*, 16*b*, 16*c*, 16*d*, 16*e*, and 16*f*. Each of these blades supports a plurality of cutting elements, each fixed to a respective blade, such as cutting elements 18 shown in FIGS. 1 and 2. Each of the blades or blades may have a generally curved trapezoidal configuration, although other configurations may be provided for the radially extending blades. The blade 16 may be provided with gauge cutters 19, which in many applications do not include PDC cutting elements.

Still referring to FIGS. 1 and 2, the drill bit includes a plurality of nozzles 20*a*, 20*b*, 20*c*, 20*d*, 20*e* and 20*f*, at each blade 16 comprising a plurality of discharge ports for jets 20*a*-20*f*, providing the high-speed jets, shown by arrows, to the respective cutters 18.

Figure 3:
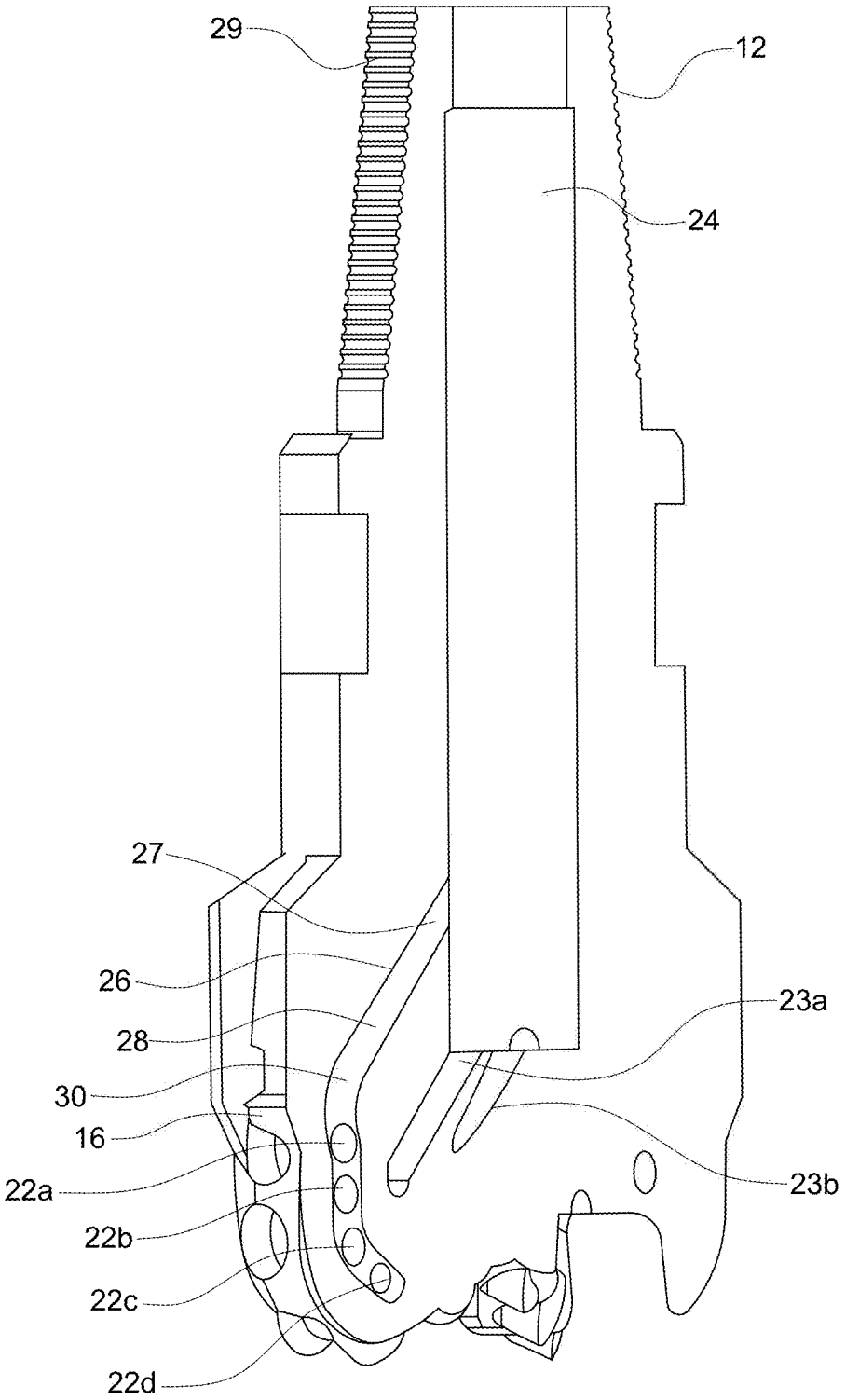
FIG. 3 is a cross-sectional view taken along lines A-A in FIG. 4.

In one embodiment where manifolds are used, each of the plurality of jets is beneficially directed toward a respective cutter to provide increased cooling and cleaning for a cutting element. A jet may be a profiled by using e.g., conical, converging hole through a wall of the blade and into the interior fluid manifold of the bit, or a desired size jet as an insert may be secured within a larger receiving hole in the blade. Each jet outputs tangentially relative to the circumferential of the drill bit body, at radial distance (lever) from the center of bit. In such arrangement the jets create torque, additional to the main torque for whole drill string. In this case drill bit works as the hydraulic motor and could provide essential saving of energy, fuel and reduce emission of carbon monoxide emanating from the main engines at the drill rig. Referring now to FIG. 3, bit body 12 includes a central flow path 24 therein for supplying fluid to the cutters. For this embodiment, manifold 26 is manufactured in each blade, and a flow line 28 transmits drilling fluid from the flow path 24 to the interior of the plenum and out through the manifold 26. The manifold 26 in turn includes a flow chamber 30 therein, with a plurality of discharge ports 20 discharging fluid jets 22*a*-22*e* from the chamber 30 to a respective cutting element 18*a*-18*e*. FIG. 2 illustrates this feature in greater detail, with jet 22*a* being directed to cutter 18*a*, jet 22*b* being directed to cutter 18*b*, jet 22*c* being directed to cutter 18*c*, and jet 22*e* being directed to cutter 18*e*. Jets are shown by arrows.

The drill bit includes a plurality of cutters on each blade, and a jet e.g., 22*a*-22*e* from blade, 16*d* is positioned for directing drilling high speed fluid jets to a respective one of the plurality of cutters on the neighboring blade 16*f*. In one example, a blade may contain seven cutters, and the manifold associated with that blade may contain seven jets, with each jet corresponding to a respective cutter. In other embodiments, however, more cutters than jets may be provided, so that one or more cutters may not have a jet specifically directed to that cutter. In yet other embodiments, a jet may be provided for each of the cutters on a blade; and referring to FIG. 5 in another embodiment jets 22 from the bottom surface of the bit body, may be provided for removing debris in a desired manner and can be directed to a specific cutter, as well. A plurality of cutters are thus provided on each blade, and preferably four or more cutters are provided on each blade. Each of the plurality of cutters provided on a blade is provided with a respective jet, although additional cutters may not have jets, and additional jets may not have a corresponding cutter. In most applications, however, at least 3 or 4 cutters each supported on a blade will be supplied with fluid from a jet directed to that cutter.

FIG. 4A-4F show various views of a plurality coolant channels with high volume coolant fluid flow or mud flow through the drill bit body head, wherein the channels provide a predetermined volume flow through the plurality of large channels inside the drill bit body providing heat rejection from a body material and increase bit rigidity and longevity especially for drilling in high temperature environment like for offshore and geothermal wells.

In one embodiment, a network of coolant channels is formed within the bit body, wherein the network of coolant channels includes a plurality of primary channels and a plurality of secondary channels; the primary channels extend substantially parallel to the longitudinal axis; the secondary channels branch from the primary channels and extend towards the blades. The network of coolant channels is configured to provide a predetermined volume flow of coolant fluid through the bit body; and the network of coolant channels is arranged to facilitate heat rejection from the bit body and increase bit rigidity.

The drill bit advanced coolant channel system incorporates a plurality of coolant channels strategically and uniformly positioned within the drill bit body head, engineered to facilitate high-volume coolant fluid flow or mud flow. The intricate network of channels serves multiple critical functions, primarily focused on enhancing heat rejection, increasing bit rigidity, and extending the overall longevity of the drill bit, particularly in high-temperature drilling environments such as offshore and geothermal wells. The coolant channels traverse the drill bit body.

In one embodiment, the network of coolant channels includes a plurality of primary channels and a plurality of secondary channels; the primary channels extend substantially parallel to the longitudinal axis; the secondary channels branch from the primary channels and extend towards the blades; the network of coolant channels is configured to provide a predetermined volume flow of coolant fluid through the bit body; and the network of coolant channels is arranged to facilitate heat rejection from the bit body and increase bit rigidity. The primary channels have a larger cross-sectional area than the secondary channels, and wherein at least some of the secondary channels terminate at fluid outlets positioned proximate to the cutting elements. The network of coolant channels may use helical channels that spiral around the longitudinal axis of the bit body. The network of coolant channels is configured to maintain a low substantially uniform temperature distribution across the bit body during drilling operations.

Figure 4A:
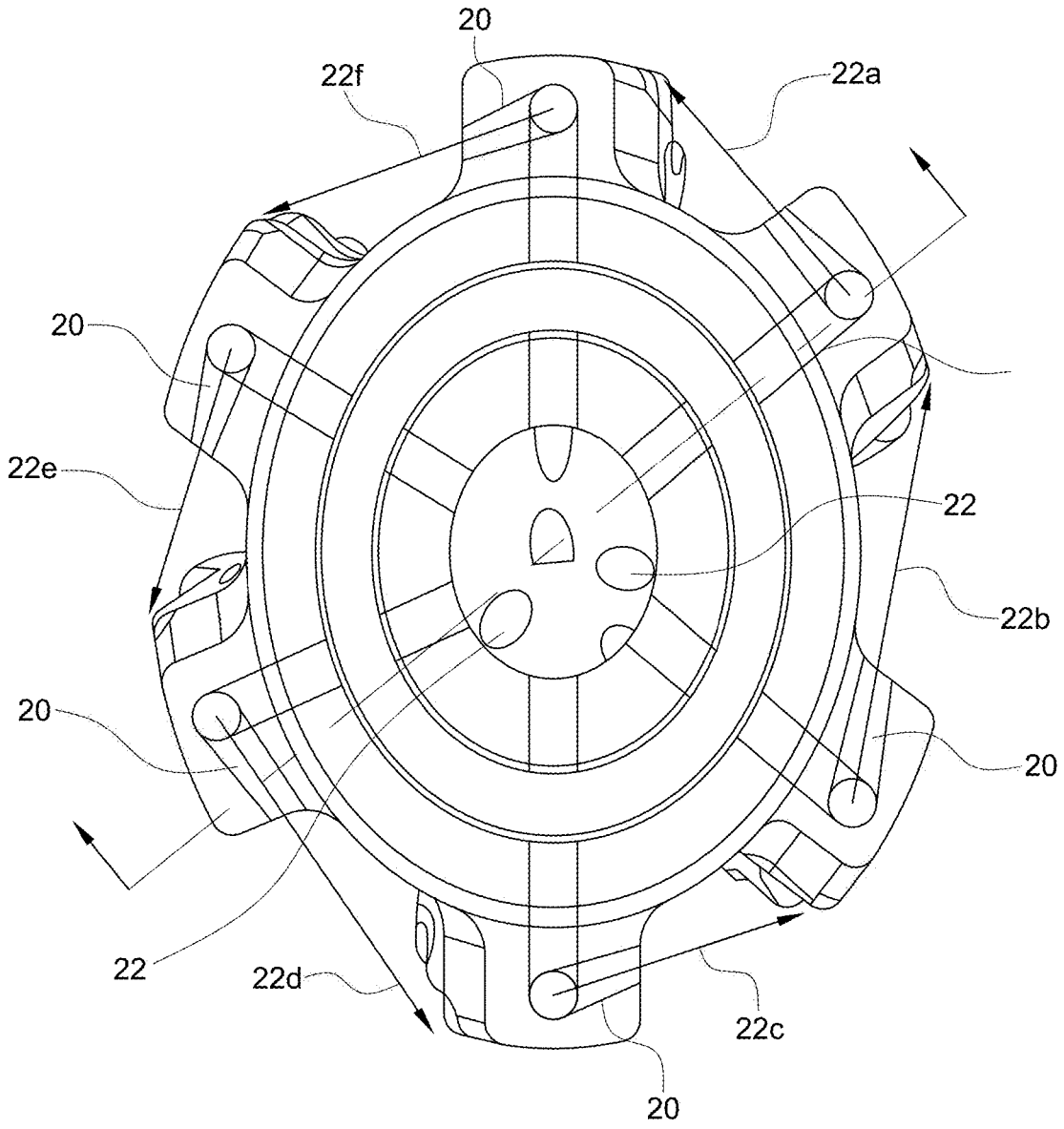
FIG. 4A show a top view of one exemplary bit.
Figure 4B:
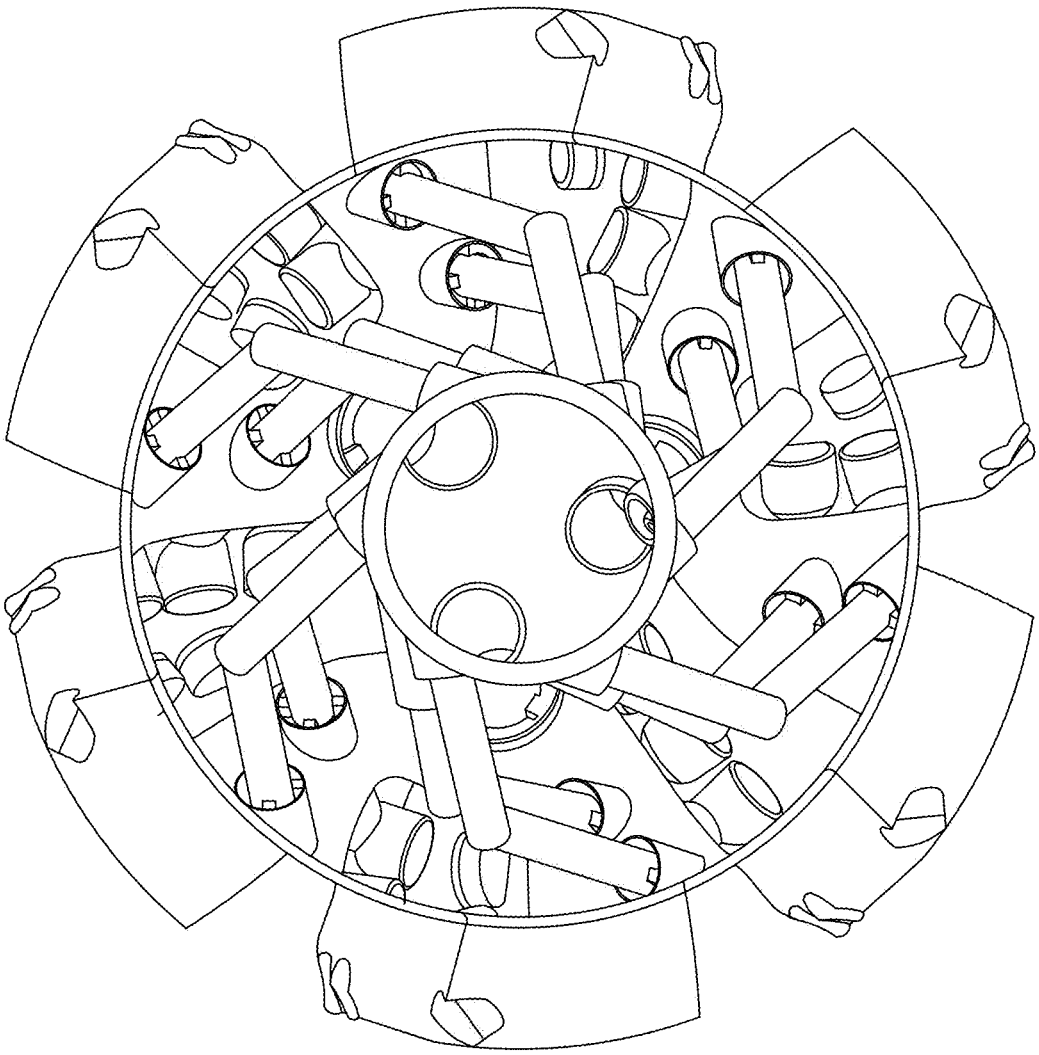
FIG. 4B-4C shows top views of a bit with angled coolant channels with high volume coolant fluid flow or mud flow through the drill bit body head.
Figure 4C:
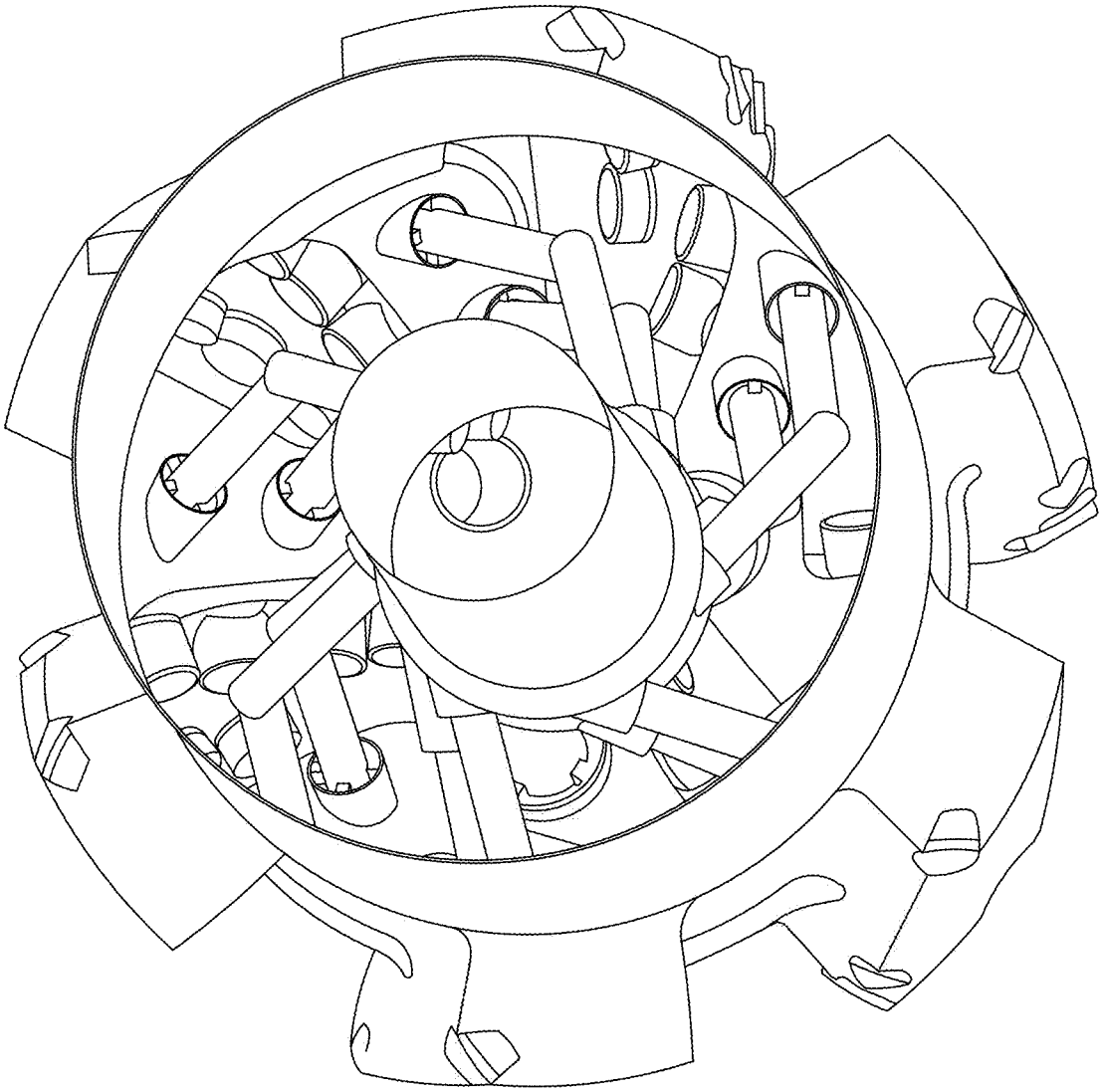
Figure 4D:
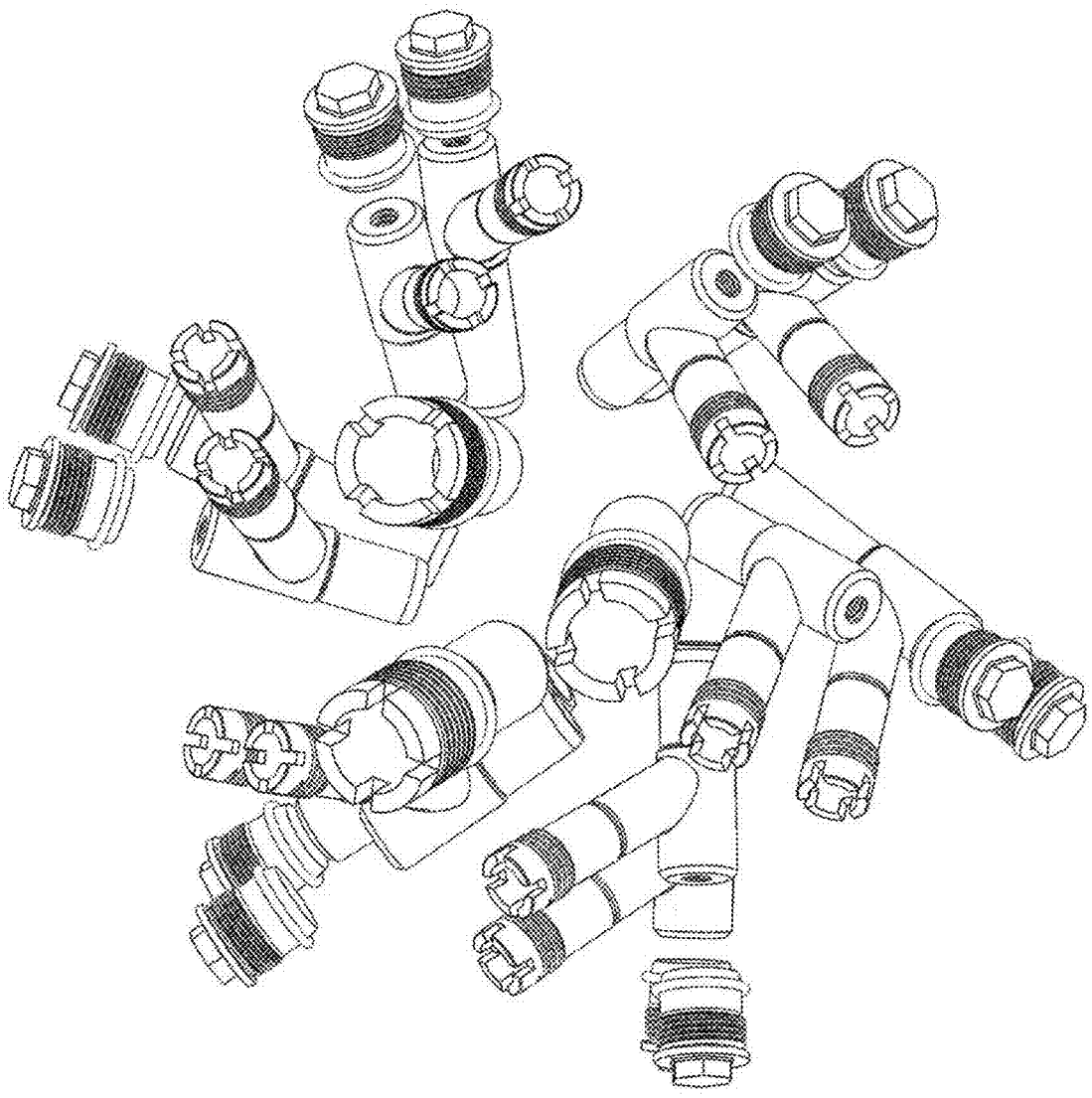
FIGS. 4D-4E shows various views of the angled coolant channels of FIG. 4A-4C
Figure 4E:
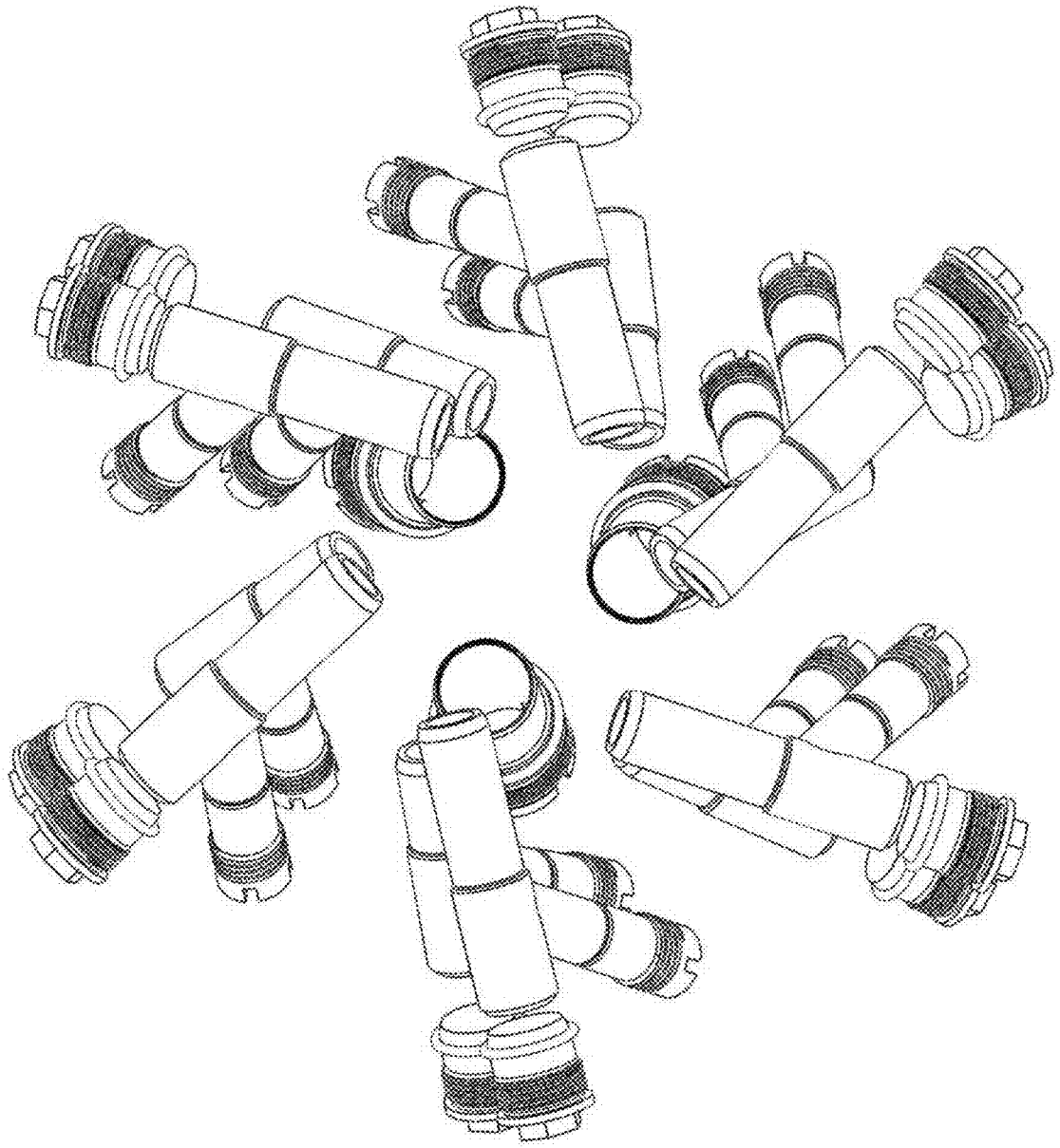
Figure 4F:
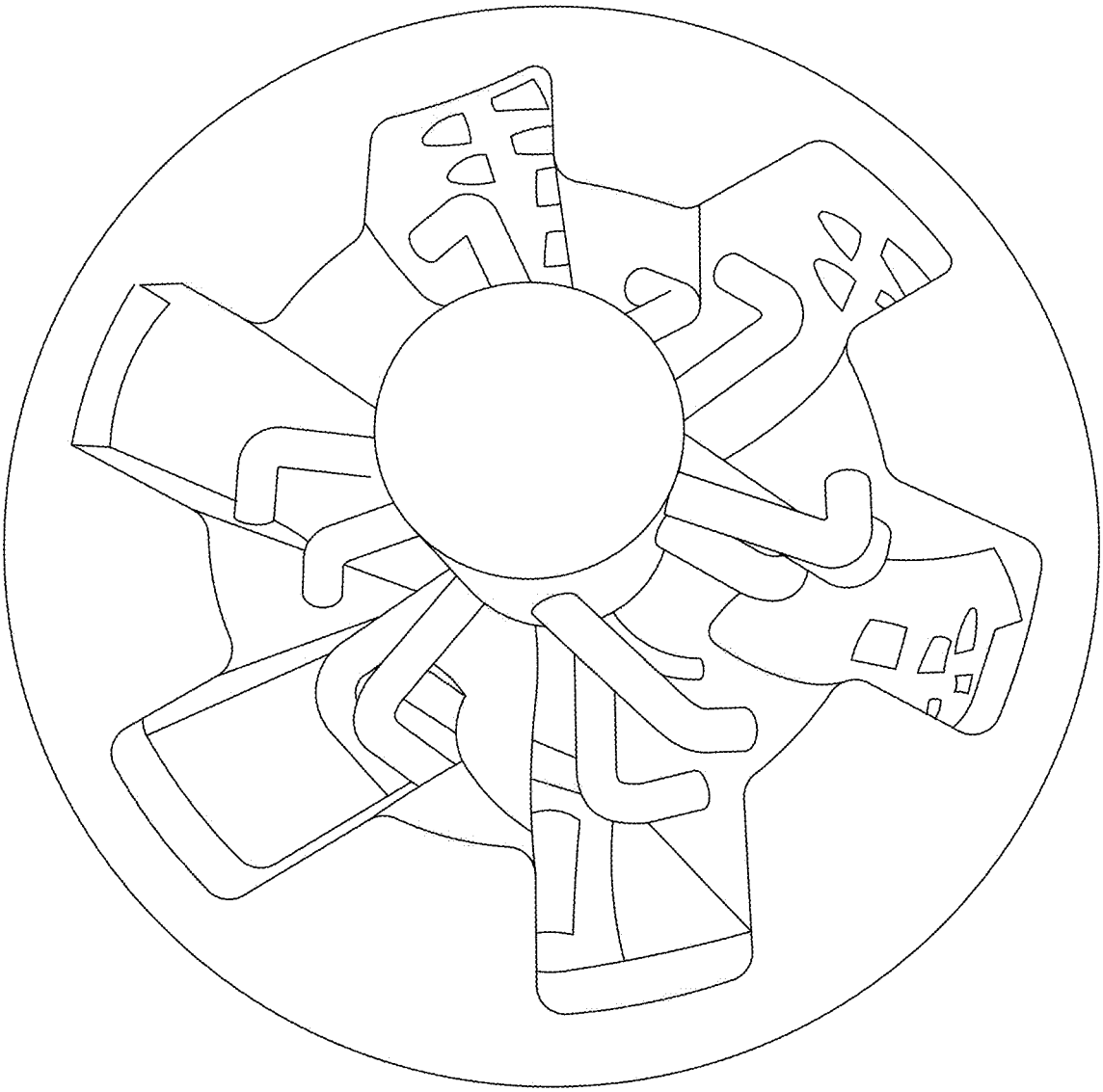
FIG. 4F shows a top view of a bit with curved coolant channels with high volume coolant fluid flow or mud flow through the drill bit body head.

FIG. 4B-4C shows top views of a bit with angled coolant channels with high volume coolant fluid flow or mud flow through the drill bit body head. In designs, the channels are angled or curved channels which allow an increase in retention time during the delivery of the water/mudflow/drilling fluids/loss circulation material for these fluids to provide heat rejection from the inner geometry of drill bit body, channels and plenum. By providing hard wearing material sleeves for these curved/angled channels the system also prevents erosion during this process. FIGS. 4D-4E shows various views of the angled coolant channels of FIG. 4A-4C, while FIG. 4F shows curved coolant channels. The channels of FIGS. 4D-4F enhance deep drilling technology, particularly for high-temperature applications such as offshore and geothermal wells. The network of coolant channels, optimized for high-volume fluid flow, addresses critical challenges in thermal management, structural integrity, and operational longevity. By integrating advanced cooling capabilities with robust structural design, this drill bit configuration promises to enhance performance, extend operational life, and expand the feasibility of drilling in extreme thermal environments. The cooling system may allow for reduced coolant fluid volumes compared to conventional designs, contributing to resource conservation and reduced environmental impact. Various manufacturing methods, such as additive manufacturing or casting techniques, may be employed to create the internal channel structures shown in FIGS. 4D-4E. The enhanced thermal management capabilities of this drill bit design may expand the range of environments and depths at which effective drilling can be conducted, potentially opening up new exploration and extraction opportunities.

These channels are carefully engineered to optimize fluid flow and thermal management:

Channel Layout: The coolant channels are distributed uniformly throughout the drill bit body, forming a complex network that ensures comprehensive coverage. This layout is designed to maximize the surface area exposed to the coolant fluid, enhancing heat transfer efficiency.

Channel Geometry: The channels exhibit varying cross-sectional shapes and sizes, tailored to specific regions of the drill bit. Some channels appear to have circular cross-sections, while others may be elliptical or have more complex geometries. This variation in channel shape is likely intended to optimize fluid dynamics and structural integrity in different parts of the bit.

Flow Directionality: The channels are oriented to guide the coolant fluid in predetermined paths. Some channels run longitudinally along the bit body, while others may follow more intricate routes, potentially including helical or branching patterns. This strategic flow directionality ensures that coolant reaches all critical areas of the drill bit.

Inlet and Outlet Configuration: The enlarged inlet ports at the top of the drill bit are designed to accept a high volume of coolant fluid. These inlets feed into the internal channel network, which then distributes the fluid throughout the bit body.

Channel Sizing: The channels are suitably dimensioned to accommodate substantial fluid flow rates. This sizing is crucial for maintaining adequate cooling capacity in extreme drilling conditions.

Flow Path Optimization: The channel network appears to be designed with fluid dynamics in mind, potentially incorporating features such as smooth transitions, gradual bends, and strategically placed expansions or contractions to minimize flow resistance and maintain high flow rates.

Heat Transfer Surface Area: The extensive network of channels significantly increases the internal surface area available for heat transfer between the bit body material and the coolant fluid. This enhanced surface area is crucial for effective cooling in high-temperature environments.

Thermal Gradient Management: The channel layout is likely optimized to create uniform cooling across the drill bit body, preventing the formation of localized hot spots that could lead to premature wear or failure.

Channel Reinforcement: The coolant channels may incorporate reinforcing features or be positioned in a way that maintains or even enhances the overall structural strength of the drill bit body.

Material Distribution: The placement of channels is likely optimized to balance material removal for fluid flow with the need to maintain sufficient material in key structural areas of the bit.

Stress Distribution: The channel layout may be designed to distribute mechanical stresses evenly throughout the bit body, preventing stress concentrations that could lead to premature failure.

The cooling provided by the channel system helps maintain the thermal stability of the drill bit, crucial for consistent performance in environments with significant temperature fluctuations. The coolant channel system is engineered to extend the operational life of the drill bit, particularly in challenging drilling environments. By maintaining lower operating temperatures, the coolant system helps preserve the material properties of the drill bit, potentially reducing wear rates on critical components. The efficient cooling provided by the channel system helps minimize thermal cycling and associated fatigue stresses, which are particularly problematic in high-temperature drilling operations. The high-volume fluid flow may also assist in flushing away drilling debris, preventing accumulation that could lead to premature wear or reduced cutting efficiency. The design is tailored for use in high-temperature drilling scenarios. In offshore applications, where deep wells can encounter extreme temperatures, the enhanced cooling capacity of this drill bit design helps maintain optimal performance and extend operational time. Geothermal drilling presents some of the most challenging thermal conditions in the industry. The advanced cooling system of this drill bit is particularly well-suited for maintaining functionality in these extreme environments.

Thermal Stability is enhanced by the design elements that allow for the regulation of coolant flow rates, enabling operators to adjust cooling capacity based on specific drilling conditions. The channel system is designed to manage fluid pressures effectively, ensuring consistent flow throughout the bit body while preventing excessive pressure buildup that could compromise structural integrity. The channel network may include features to ensure even distribution of coolant to all critical areas of the drill bit, preventing localized overheating or undercooling. The drill bit design can incorporate features for real-time performance monitoring and optimization:

- Sensor Integration: The bit body can include integrated sensors for monitoring temperature, pressure, or flow rates within the coolant channels.
- Data Feedback: Information from these sensors can be used to provide real-time feedback to drilling operators, allowing for dynamic adjustments to drilling parameters or coolant flow rates.
- Predictive Maintenance: The ability to monitor internal conditions can enable predictive maintenance strategies, optimizing bit replacement schedules and reducing downtime.

Figure 5:
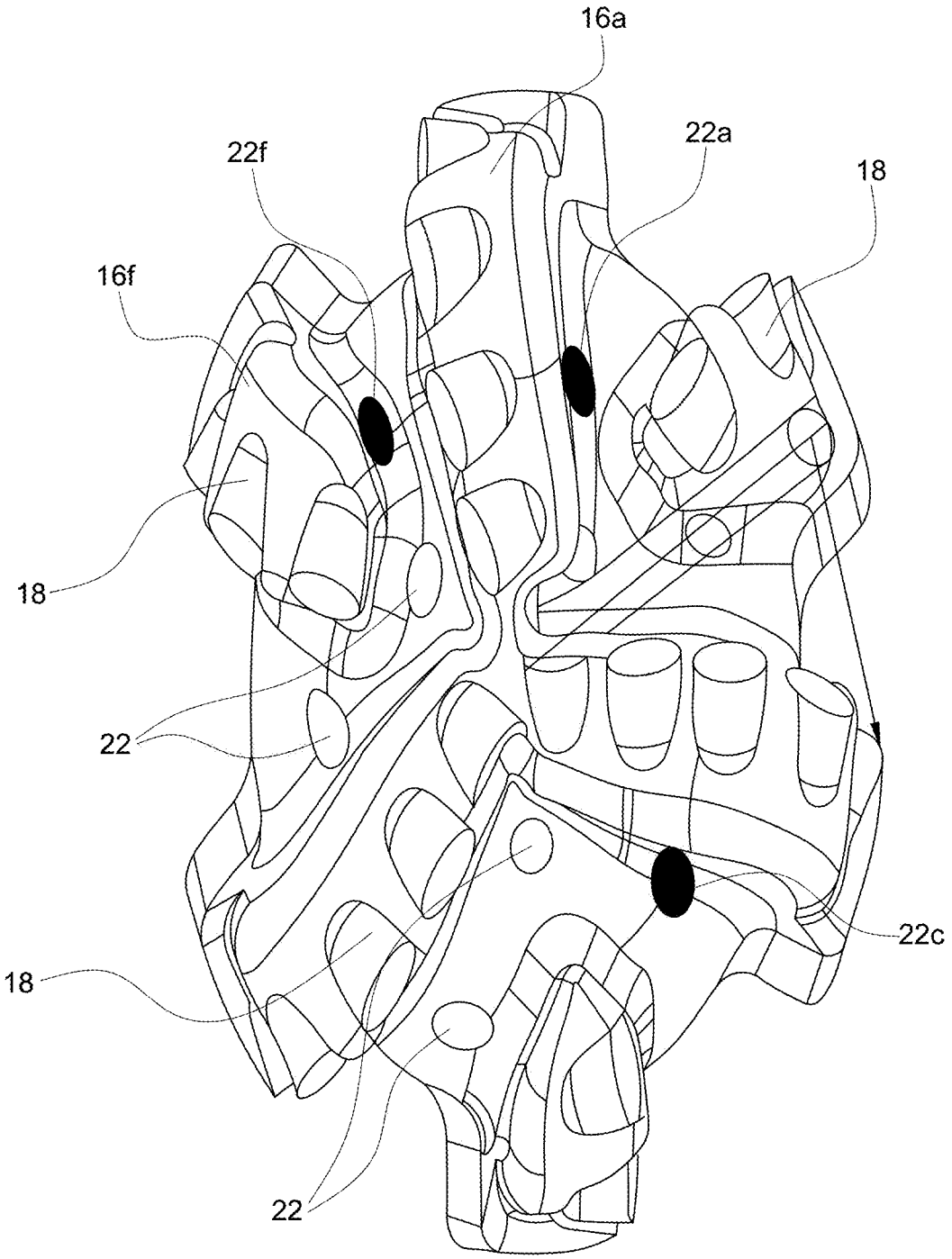
FIG. 5 is a bottom view of the drill bit shown on FIG. 1.

For the embodiment as shown in FIG. 2 and FIG. 5, each of the jets 22*a*-22*e* provided on the blades and in the junk slot area 26 are spaced a uniform distance from each other. This provides substantially equal fluid velocity from each jet to a respective cutter.

For the embodiment as shown in FIGS. 2-5, the manifold 26 is similarly provided for each blade. FIG. 5 discloses a drill bit 10 which is similar to the drill bit shown in FIG. 1, except that the jets in the blades manifold 16*a*-*e* are not spaced a uniform distance from the cutters 18*a*-*e* fixed to the blade 16*f*, and instead the spacing between a jet and a respective cutter increases as a function of the radially outward distance of the cutters and the jets from the centerline of the bit.

As shown in FIG. 5, this allows the blades extending outside the plenum and bit body to be spaced substantially equidistantly, which may provide for better lubrication and flow of drilling fluids and solids into the annulus above the bit. The spacing between a jet and a respective cutter increases as the cutter spacing from the centerline of the bit increases, thereby increasing the washing area adjacent the cutters and improving removal of debris. FIG. 2 shows a central jet path 22*a* from the central axis of the discharge port or nozzle 20*e* for each jet 22*a* to the primary cutting surface 18*a* on the face of the bit.

The correlation between a jet and the respective cutter does not appear to be linear for the previous embodiment since the cross-section is taken through the blades manifold, which is not parallel to the face of the cutters on a blade. Each jet central jet path 22*a*, 22*b*, 22*c*, 22*d*, 22*e*, 22*f* is illustrated in FIG. 2. Manifold 26 as shown in FIG. 3 includes an inlet port 27 for directing fluids into the interior of the blade's manifold cavity 30. The manifold itself as shown in FIG. 3 may be manufactured in various manners in the bit body, e.g., with 3D printing drill head technics and/or drilling and welding. Another way to distinguish the jets in a drill bit of this design from the prior art relates to the high percentage of momentum of fluid from a specific jet which directly engages a primary cutting edge and surface of a respective cutter. According to this design, a high percentage of the high fluid momentum from a jet is focused and directed to a respective cutter which is highly beneficial to desired cooling and cleaning of a cutting element. The spacing between a jet exit plane and the respective cutter face also is preferably less than 11 times the mean diameter of the jet discharge, and in many cases is 10 times or less the mean diameter of the jet at discharge. The drill bit 10 as shown in FIG. 1 is substantially similar to the FIG. 5 embodiment, with each blade's manifold 26 being spaced approximately equally according to the spacing between blades. As seen more clearly in FIG. 3, cavity 26 in the blade manifold is formed directly in the blade body 16*a-e*. The blade manifold includes a plurality of jets 22*a-e* each for directing fluid to a particular cutter 18*a-e*, as previously discussed. The flow path 28 in the plenum and bit body supplies fluid from the central cavity 24 to the exterior cavity out to the cutting surface where the diamond cutters are shearing at the inception.

FIG. 2 illustrates in further detail that the blade manifold can be made in the blade, which is manufactured separately from the drill bit head and then can be welded to the bit head body. Each of the jets 22*a-e* has fluid jet flow directed to a particular cutter, 18*a-e* as discussed for the prior embodiment. This built-in design may also be used for the manifold positioned as shown in FIG. 1-2. FIG. 3 is a cross-sectional view of yet another embodiment of a drill bit body 12 with a central flow path 24 therein, and a plurality of cutters 18 each affixed to a respective one of a plurality of circumferentially spaced blades, as discussed above. This embodiment does utilize a blade manifold, and a plurality of flow channels 28 each connecting the central flow path 24 to a respective jet, which in turn directs cooling fluid jet to a respective cutter 18. A plurality of cutters is conventionally provided on each blade, and FIG. 2 depicts a flow line 22*a* for each of the plurality of cutters, so that the six cutters as shown in FIG. 2 are each provided with a respective flow line 28 emanating from the central flow path 24. FIG. 2-4 shows in greater detail each of the flow paths 28 which has a discharge jet 22*a* at the discharge end 20*e* thereof for directing a jet to a respective one of the cutters. The flow paths 28 may be provided in the bit body or may be provided in the whole blade insert separate from the head and fixed to the bit body, so that the discharge ports are spaced in the blade supporting a respective cutter. In the event that the drill bit was to become partially plugged, the drilling operator may lift the drill bit off the drilling surface and increase fluid pressure and rotate bit idle without drilling. In this case the fresh mud fills the annulus and after reducing mud pressure that fresh fluid backwashes into the drill pipe, thereby flushing the flow paths and jets with fluid.

Figure 6:
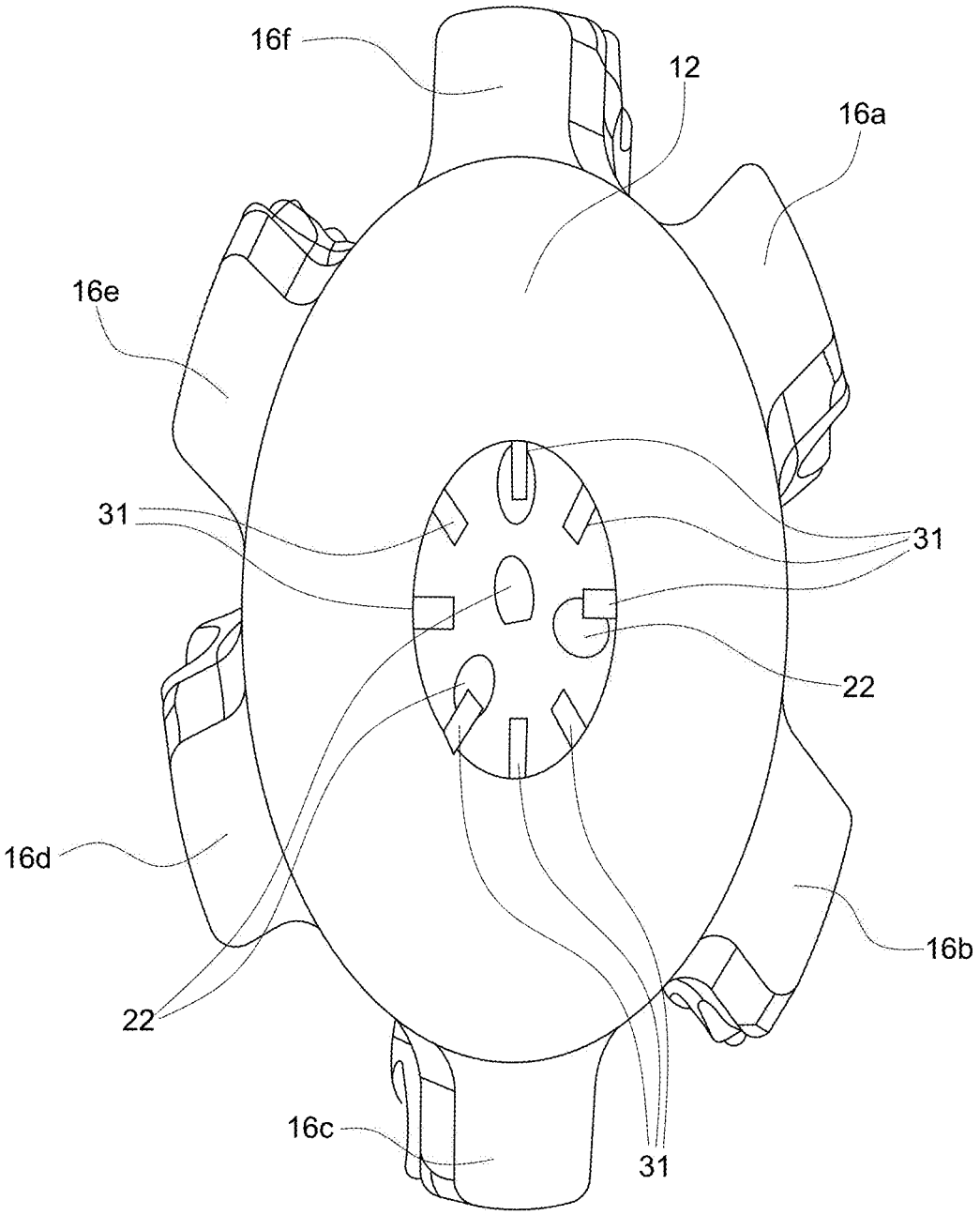
FIG. 6 is a top view of the drill bit's head with the interior fins and channels.

In another embodiment, referring FIG. 6, shows the internal cooling channels 22 and fins 31 in the drill bit head. The fins length propagates from the beginning of the bit head to the bottom of internal surface of the fluid channel 24. The cooling channels between the fins 31 have a rectangular profile with the thin fins and a wide base between the fins. The ratio of channel base, size between adjusting fins, to the fin thickness is in the range from 3 to 7. And the ratio of the fin's height to the channel base size is in between 2 and 3. The fin increases the heat transfer area and increases the heat rejection from the drill bit metal to fluid up to 100%. The fin's channels can be helical. This embodiment is very important for drilling a deep well where the temperature of the formation is high.

In another embodiment, a method of drilling a hole includes providing a bit body with a plurality of cutting elements each fixed to a respective one of a plurality of radially extending blades, as discussed above. The method includes directing fluid from the bit body flow path to a plurality of flow nozzles each of them is forming high speed jet for directing this fluid jet to a respective one of a plurality of cutting elements to clean and cool the cutting elements. A blade could be made separately with the blade's fluid manifold and then fixed to the bit body. The blade manifold will provide fluid flow from a bit body flow path and outputting fluid through the plurality of flow nozzles. The bit body may include a plurality of flow path as 23*a* and 23*b* on FIGS. 4 and 22 on FIG. 6, each extending from the bit body surface, not only from the blades, to a respective one of the plurality of cutters.

Other features of the method of the design will become apparent from the foregoing description. The centerlines 22*b* on FIG. 4A of fluid flow from each nozzle is within a range of a line passing through a central axis of the nozzle discharge port or nozzle 20 and a primary cutting surface on a respective cutting element, and in many applications this jet centerline is within small angle of a line passing through the nozzle central discharge port and a primary cutting surface, particularly when the jet discharge port is generally circular rather than being elliptical or slot-shaped. As discussed above, the drill bit of the present design includes a plurality of circumferentially spaced blades, and each blade has fixedly mounted thereon a plurality of cutters. Larger diameter bits conventionally have more cutters, and also have a larger central flow path through the bit. According to the present design, the mean diameter of the discharge port from each nozzle or jet is less then intake diameter. In many applications, the mean length of the discharge port will be from 5 to 10 of the discharge nozzle diameter. The exit hole diameter may increase for jets spaced radially outward from the bit centerline, particularly if the spacing between the jet and a respective cutter increases with this increased spacing. Each nozzle conventionally may have a circular discharge opening, but other configurations for an opening could be provided. In either event, the mean diameter of the opening is relatively small compared to prior art bits, since a discharge nozzle is preferably provided for cooling and cleaning one cutter, rather than a plurality of cutters. The use of multiple high speed fluid jets each directed to a respective cutter on the drill bit provides many benefits, such as improving the cleaning and scouring action, helping to remove the chip characteristics, and a better environment for the cutter and formation contact, which reduces the tooth wear, due to lower temperature of the cutter edge, because of the high speed jet provides higher heat rejection from the cutter edge, lubricates the cutters/diamonds, provides uniform hydraulic balance for the drill bit, and reduces the "whirl' effect by providing more uniform cooling of the cutters and a cutting surface more uniformly affected by each of the plurality of cutters. The jets in current drill bit design, provide the maximum cooling of an individual tooth, reducing the temperature of the cutter tip, and improving rigidity characteristics. These improvements increase the ROP provide longer bit life and allow for drilling longer intervals with few or no loss in ROP. The design reduces erosion of the cutters as result of a heat stress reduction and the reduction of the entrained drill cuttings in the mud moving past cutters at the point of formation contact by a jet, each achieved by supplying fresh fluid, with no drillings, to each cutter. Another main advantage provided by this design is the reduction of the cutter's edge temperature due to intensive reduction of heat stress on the cutters. In a conventional drill bit, mud first flows to the dome and on the return goes through the junk slots, which have a relatively large area. The mud velocity became thus small and consequently the coefficient of heat transfer is small compared with the present design.

Another advantage is that during the cutting process, each jet helps to break the chips into smaller parts by applying hydraulic energy directly to the contact place between the primary cutting surface of a cutter and the formation. Better cleaning, cooling and lubrication of each individual cutter increases the rate of penetration and the operating hours for the drill bit. All advantages described above allow to use one drill bit to make the bore in one pass. Also allow us to reuse the same drill bit for multiple drilling.

The innovative design of the drill bit incorporates several distinct elements, which come together to enable highly efficient and effective drilling operations. This drilling bit comprises a bit body with a leading cutting face and outer peripheral edges. This bit body is specialized by the inclusion of numerous radially extending blades, which in configuration leave ample space for a flow channel between each set of adjacent blades. These structures consolidate to form a unique bit body flow path which sits radially inward of the peripheral edges, significantly enhancing the performance of the drilling bit.

The distinct characteristic of this rotary drill bit is the strategic mounting of a plurality of cutting elements. Each of the cutting elements is rigidly mounted on a respective one of the radially extending blades. These cutting elements form the active operational feature of the drilling bit, allowing for the formation of holes in various substrates of varying hardness and consistency.

The structure of this rotary drill bit includes a plurality of flow nozzles located on each blade's manifold. These nozzles are in fluid communication with the bit body flow path and their strategic positioning and operation play a key role in maintaining the sharpness and overall performance of the cutting elements. The nozzles function to create and direct high speed fluid jets, specifically aimed towards the cutter's edge.

One function of these fluid jets is to clean and cool the cutting elements. Without this feature, the cutting elements could quickly become clogged with debris and reach high temperatures that would compromise the integrity of the bit. The fluid jets effectively wash away the debris and maintain a manageable temperature at the cutting edge, significantly extending the operational life of the drilling bit.

Further enhancing the flexibility and performance of the rotary drill bit is the provision of manifolds for receiving a fluid flow from the bit body flow path. These are positioned inside of each blade, designed in such a way that the fluid flow emanates tangentially to the circumference of the bit body.

Integration of the conical flow nozzles with discernible structures such as the plurality of cutting elements mounted on a respective neighboring blade is a unique mechanism. It prioritizes the tangential fluid flow from the blade manifolds, channeling it towards each cutting element to maximize cooling effect and debris removal, thus optimizing drilling efficiency.

Finally, the positioning of each manifold and the plurality of nozzles on each blade on an opposite side of the cutters (backside to the cutters) adds a dynamic aspect to the functionality of the rotary drill bit. This design element creates torque in the same direction as applied to the drill bit, thus enhancing the bit's drilling speed and overall performance. This optimal combination of elements makes this rotary drill bit an effective tool in a wide range of drilling scenarios.

One embodiment of the drill bit includes a body assembly having a threaded section for connection to a drill string and includes a plurality of cutter carrying blades extending radially from the body assembly, each cutter carrying blade extending axially and radially and having cutting elements disposed thereon. It is known in the art to use drilling fluid (also referred to as drilling mud) for both cooling and lubrication purposes as well as for assisting with the removal of cut material from the borehole.

Preferably, one or more nozzles are positioned on a blade opposite side of the cutters. This specific placement allows for a radial distance from the rotation center of the drill bit which is key to creating a lever and increasing the torque of the drill bit. These nozzles are purposed to direct jets of drilling mud tangentially relative to the body assembly. The power of the hydrojets thus provides tangential momentum to the drill bit, greatly enhancing its power and effectiveness. Essentially, the drilling fluid is used to forcefully create a high-speed jet that provides a mechanical advantage to the drill bit, adding stability, optimizing rotation speed and reducing the frequency of bit stalls significantly.

The system further improves drilling efficiency by allowing improved flow of drilling mud to the borehole face, while simultaneously reducing the likelihood of bit balling, wherein cuttings accumulate at the face of the bit and hinder drilling operations. Furthermore, the radial placement of the nozzles provides a balanced effect on the drill bit, ensuring maintenance of balance and stability during rotation. This unique positioning of the nozzles also allows for effective cooling and cleaning of cutters, enabling optimum efficiency of drilling operations. It facilitates effective control over drill bit torque while maintaining high speed, leading to materially reduced drilling time and therefore reducing costs significantly. The proposed drill bit design hence presents an innovative and much-needed solution for efficient and effective drilling in subsurface formations.

The rotary drill bit features one or more nozzles that provide a unique hydro-motor feature, generating torque momentum through the utilization of hydrojets. The primary purpose of this added feature is to optimize and augment the drill bit's efficiency and longevity in challenging drilling conditions. In the preferred embodiment, one or more nozzles are strategically located on the rotary drill bit, exerting high-pressure fluid jets-hydrojets. The kinetic power of the exiting fluid results in torque, thereby creating mechanical advantage that is transferred to the rotary motion of the drill bit. This particular operational principle of transforming hydraulic energy into mechanical energy significantly enhances the overall drilling speed, reduces wear on the drill bit, and thus prolongs its service life.

The hydro-motor feature in this rotary drill bit is an innovative solution to common drilling problems, such as high wear and slowness, encountered in harsh drilling environments. Its integration into the drill bit design enables efficient utilization of the downhole hydraulic power made available during the drilling process. It can be advantageously applied across a variety of drilling operations, including mining and exploratory drilling. The drill bit system offers immense potential in enhancing the efficacy of drilling operations, demonstrating a significant improvement over conventional drill bits. Furthermore, the hydromotorized drill bit is designed to be stable, sturdy, easy to use, maintain, and offers a greater degree of control over drilling operations.

The drill bit system provides one or more nozzles with a specially designed converging profile. This innovative feature is designed to enhance the performance and efficiency of drilling operations, particularly those involving the use of drilling mud. The converging profile of the nozzles allows for an increase in the flow velocity of the drilling mud at the discharge end, facilitating more efficient rock cutting, bit cleaning, and chip removal.

The converging profile of the nozzles works by narrowing the path for the drilling mud, thereby maximizing the speed, and carrying momentum of the flow. As the drilling mud is forced through these narrowed channels, it increases in velocity, thereby gaining dynamic pressure necessary for better rock cutting and removal of cuttings from the drill bit. This design further improves the flow-through capacity of the bit, simultaneously advancing the cleaning and cooling function of the drill bit during operation.

The rotary drill bit provides distinct advantages compared to traditional designs. The introduction of the converging profile nozzle design results in a much more dynamic and efficient flow of drilling mud. This leads to several improved operational benefits, such as enhanced drilling speed, reduction in drill bit wear and, thus, increased lifespan of the drill bit, and improved overall drilling performance. The specialized profile allows the bit to handle higher flow velocity of drilling mud, resulting in more efficient drilling processes that help to reduce costs, increase operational efficiency, and ultimately improve the extraction of resources.

The system offers a significant technological leap by incorporating a plurality of cutting elements, each meticulously mounted on a respective blade poised to provide exemplary drilling performance. These elements comprise of face cutting elements and side cutting elements, synergistically working together to deliver an exceptional cutting process to the user. The face cutting elements are designed to define a leading cutting face placed substantially perpendicular to a bit centerline. This scientific construction allows for precision in drilling, ensuring that the user can make burrow holes at a specific target location in the earth formation with the highest accuracy. This ingenious aspect of the design enables the face cutting elements to break apart the rock or other subterraneous formations effectively while maintaining the structural integrity of the drill bit even under high-pressure scenarios.

Adjacent to the leading cutting face, the novel rotary drill bit further comprises side cutting elements located adjacent to the outer peripheral edges of the bit body. These side cutting elements have a dual purpose. Firstly, they assist in cutting the lateral margins of the hole, contributing to the overall drilling performance. Secondly, they prevent excessive wear and tear on the external circumference of the bit during use. This design feature thereby supports a longer-lasting drill bit, possibly reducing the overall operational cost of the borehole drilling project. Each of these elements cohesively aids in the primary function of the rotary drill bit, ensuring an optimal, reliable, and efficient operation.

In one embodiment, the rotary drill bit features manifolds discretely embedded within the plurality of radially extending blades. This structure aims at implementing an enhanced distribution of drilling fluids, increased efficient rock fragmentation and significant reduction in drill bit wear and tear.

The rotary drill bit includes a main body that encapsulates a cavity, from which several radially extending blades project outward, providing the bit with its cutting edges. Each radially extending blade accommodates an internal manifold. These manifolds are strategically located inside the blades, enabling not only the uniform distribution and disposal of drilling fluid but also contributing to the structural integrity of the drill bit. Placing the manifolds within the blades provides an effective protective shield from external elements and drilling obstacles, thereby extending the bit's lifespan. Further, it also optimizes the amount of drilling fluid reaching the drill's cutting surface, evidently resulting in improved operational performance.

The congruent pairing of the manifold and the radial blade enhances the effectiveness and longevity of the drilling operation. The integration allows for better pressure management and fluid distribution which is crucial in mitigating extreme conditions such as heat and cavitation. In addition, the innovative design allows for easy access and eventual replacement of the manifold if required. The fine tuning of such parameters provides a hereto unparalleled level of control and precision in drilling operations. Thus, this design amalgamates functionality, durability and efficiency into a single, robust structure, thereby facilitating advanced drilling dynamics.

The drill bit also features multiple flow lines extending from the bit body's existing flow path. The uniqueness of design lies in each flow line extending to a respective one blade's manifold before connecting to a plurality of nozzles from this specific blade's manifold. This configuration provides a more efficient distribution of drilling fluid throughout the drill bit and aids in cooling down drill bit components for optimal operational performance and longevity.

The main component of the rotary drill bit, the bit body, contains an internal flow path. This flow path allows for the passage of drilling fluid. Flow lines are strategically integrated into the bit body's flow path and they extend out towards the blades of the bit. Each blade possesses a singular attributable manifold. This manifold acts as an intermediate channel, permitting the passage of drilling fluid from the flow line into the respective blade. The distinctive feature of this arrangement is the ability of strategically angled port to directly further distribute the drilling fluid to multiple nozzles.

The design provides a dual-purpose function which not only effectively carries out the drilling operation but also improves the life-span of the tool by cooling down the components. This design not only improves the operational performance by swiftly and evenly distributing the drilling fluid but also enhances the drill bit's longevity by reducing heat associated wear and tear. The drilling fluid flow is improved immensely as it travels from the main flow path in the bit body, via multiple flow lines, through the blade's manifold, finally expelling from the design's multiple nozzles. Through the implementation of this innovative design, the rotary drill bit vastly enhances the efficiency and effectiveness of the drilling operation while minimizing risk of overstress and overheating of the bit components.

The bit body having a face at one end, a shank at the opposite end, and an internal fluid passage connecting a fluid supply at the shank end with a plurality of nozzles mounted in the bit face; several cutting elements, each having a primary cutting surface; a nozzle discharge port in each nozzle; and each nozzle is designed in such a way that a center line of fluid jet flowing from each nozzle is directed to the primary cutting surface of the cutting edge on a respective cutting element.

In regular drilling applications, having an efficient cooling and material removal process can significantly enhance the drill bit lifespan and performance. The spatial orientation and design of the nozzles on the design play a key role in that efficiency. The unique strategic alignment of the nozzle ensures that the optimum flow of the jet fluid is directed towards the primary cutting surfaces on the cutting elements, providing enhanced cooling and removal of drilling cuttings from the bit face. This ideal positioning reduces cutters temperature, and increases the strength of the cutters materials, in result reduces a wear and tear on cutting elements, particularly during high-demand drilling operations, increasing overall drilling efficiency and reducing costs.

Further, this innovative design also reduces the potential for clogging in the cutting elements as the precise angular positioning optimizes the fluid flow, creating a cleaner and more efficient drilling operation. This enhancement subsequently decreases the requirement for frequent maintenance higher, leading to more uninterrupted drilling operation time for a reduced overall cycle time in various drilling applications. With the potential to improve drilling efficiency dramatically, this rotary drill bit design offers an impressive advancement in drilling technology. The consistency of the cooling, lubricating, and cleaning features offered by this high precision engineering solution brings about substantial improvements in the operational performance and reliability of drilling systems.

In one design, a rotary drill bit for drilling a hole in a subsurface formation includes:

- a bit body having a leading cutting face and outer peripheral edges, the bit body including a plurality of radially extending blades with a flow channel between adjacent blades, the bit body further including a bit body flow path radially inward of the peripheral edges;
- a plurality of cutting elements each fixedly mounted on a respective one of the plurality of radially extending blades;
- a plurality coolant channels with high volume coolant fluid flow or mud flow through the drill bit body head, wherein the channels provide a predetermined volume flow through the plurality of large channels inside the drill bit body providing heat rejection from a body material and increase bit rigidity and longevity especially for drilling in high temperature environment like for offshore and geothermal wells.
- a plurality of flow nozzles on each blade's manifold in fluid communication with the bit body flow path for creation and directing high speed fluid jets directed to the cutter's edge from manifold to a respective one of the plurality of cutting elements to clean and cool the cutting element; and
- manifolds for receiving a fluid flow from the bit body flow path located inside of each blade, wherein the fluid flow is outputting tangentially to the circumference of bit body through a plurality of conical flow nozzles to the respective plurality of cutting elements mounted on a respective neighboring blade and wherein the blade's manifold positioning each of the plurality nozzles on an opposite side of the cutters (backside to the cutters) to create the torque in the same direction as applied to the drill bit.

Implementations of the rotary drill bit can also include one or more of the following:

- one or more nozzles provide a hydro-motor feature to the drill bit by creating torque momentum through the hydrojets.
- one or more nozzles with a converging profile to increase mud flow momentum.
- the plurality of cutting elements each mounted on a respective blade include face cutting elements for defining the leading cutting face substantially perpendicular to a bit centerline and side cutting elements adjacent the outer peripheral edges of the bit body.
- The manifold located inside of blades is provided for each of the plurality of radially extending blades.

Implementation of the above bit can include one or more of the following:

- a network of a plurality of flow lines each extending from the bit body flow path to a respective one blade's manifold and then to the plurality of nozzles from this blade's manifold.
- a center line of fluid jet flowing from each nozzle is directed to the cutter's surface edge which is in contact with the formation.
- each nozzle has the conical profile and a mean intake, located in the blade's manifold, with a bigger diameter and lesser discharge diameter.
- a network of coolant channels formed within the bit body, wherein:
- the network of coolant channels includes a plurality of primary channels and a plurality of secondary channels;
  - the primary channels extend substantially parallel to the longitudinal axis;
  - the secondary channels branch from the primary channels and extend towards the blades;
  - the network of coolant channels is configured to provide a predetermined volume flow of coolant fluid through the bit body; and
  - the network of coolant channels is arranged to facilitate heat rejection from the bit body and increase bit rigidity.
- primary channels with a larger cross-sectional area than secondary channels, wherein at least some of the secondary channels terminate at fluid outlets positioned proximate to the cutting elements, and wherein the network of coolant channels spiral around the longitudinal axis of the bit body.

In another design, a method of drilling a hole in a subsurface formation includes:

- providing a bit body having a plurality of radially extending blades with a flow channel between adjacent blades, the bit body further including a bit body flow path radially inward of its peripheral edges; fixedly mounting a plurality of cutting elements on a respective one of the plurality of radially extending blades;
- providing a plurality coolant channels with high volume coolant fluid or mud flow through the drill bit body head;
- providing a blade's manifold for receiving fluid flow from the bit body flow path and outputting fluid through a plurality of conical profile's flow nozzles to a respective plurality of cutting elements mounted on a following neighboring blade, the blade's manifold positioning each of the plurality of nozzles on the back side of the blade's and facing to the cutters on the following blade; and providing a plurality of flow nozzles each in fluid communication with the bit body flow path for directing fluid to the blade's manifold and then to respective one of the plurality of cutting elements.

Implementation of the above method can include one or more of the following:

- Providing the blade's manifold for each of the plurality of radially extending blades.

Directing a centerline of fluid flow from each nozzle to the cutter's surface edge which is in contact with the formation and provides shearing/compression actions in drilling process.

increasing the torque on the drill bit by using multiple hydrojets of mud which provide tangential momentum and placing the hydrojets nozzles on blade's opposite side of the cutters at radial distance from the rotation center of drill bit to create a lever.

creating torque momentum through the hydrojets with a conical, converging nozzle profile, and increasing jet exit velocity from the nozzle.

reducing the power consumption and hazard pollution, formed by the rig's engines which are used to rotate the drill bit and hole string, by using the hydro-motor features of the drill bit.

increasing the heat rejection from the head of the drill bit to the mud by making the internal cooling channels in the PDC or Tricone drill bits head.

providing cooling channels with a rectangular profile with thin fins and a wide base between the fins.

a ratio of the channel base size to the fin thickness is in the range from 3 to 7 and a ratio of the fin's height to the base is 2.

Figure 7:
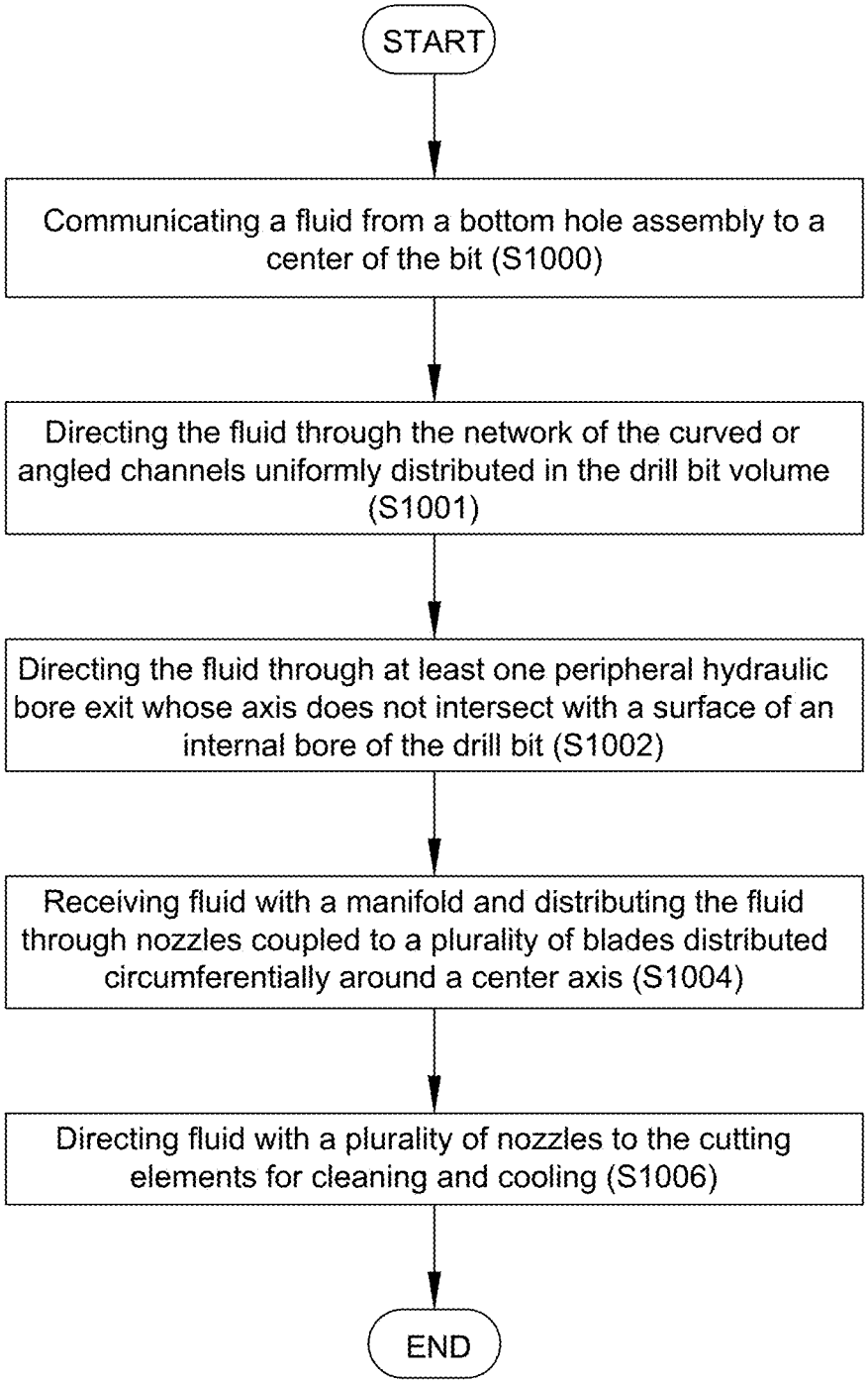
FIG. 7 shows an exemplary drilling method.

FIG. 7 illustrates the following steps in the rotary drill bit's construction to provide hydraulic cooling. A method for drilling includes communicating a fluid from a bottom hole assembly to a center of the bit; directing the fluid through at least one peripheral curved or angled channel which than directs mudflow out to an angled port with and interchangeable nozzle whose axis does not intersect with a surface of a bore of the drill bit; receiving fluid through the plenum "In a PDC (Polycrystalline Diamond Compact) drill bit, the "plenum" refers to a chamber within the bit body that serves as a reservoir for drilling fluid, allowing it to be evenly distributed across the cutting cutters/diamonds and efficiently channeled through the bit to remove cuttings from the wellbore during drilling; essentially, it's the area where drilling fluid accumulates before being directed out through nozzles to the cutting face and bit" plenum and bit body and distributing the fluid through nozzles coupled to a plurality of blades distributed circumferentially around a center axis; and directing fluid with a plurality of nozzles to the cutting elements for cleaning and cooling.

The method includes receiving fluid from the drill bit body using a manifold. This fluid is then redistributed through various nozzles. The nozzles direct the fluid onto cutting elements to facilitate their cleaning and cooling during the drilling operation. The multiple blades around a central axis on the drill bit 10 are attached to a bore 24 that channels hydraulic fluid from the bottom hole assembly to the center of the bit, facilitating the operation and efficacy of the drilling process. At least one peripheral curved or angled channel is positioned such that its axis does not intersect with the bore surface. This configuration ensures efficient fluid delivery, enhancing the hydraulic flow dynamics for effective cooling and cleaning of the cutting elements.

The method involves forming a bit body characterized by a leading cutting face and distinct peripheral edges. This bit body integrates multiple radially extending blades, each equipped with a dedicated flow channel situated between adjacent blades. A plurality of cutting elements is mounted onto these blades. The system then directs fluid through a series of nozzles aimed at the cutting elements mounted on the blades. This fluid transfer is designed to facilitate the cleaning and cooling of the cutting elements during the drilling operation, ensuring optimal performance and prolonging the lifespan of the components. This process is integrated with a manifold system that effectively collects and redistributes the fluid to maintain continuous operation.

One embodiment provides a conical profile of these nozzles, each possessing a mean intake located in the blade's manifold with a bigger inlet diameter, and a lesser discharge diameter. This configuration allows for the controlled flow of drilling fluids, facilitating the removal of cuttings from the drilling surface, ultimately improving the drilling process efficiency and reliability. The conical profile of the nozzles in the rotary drill bit assists in increasing the velocity of the fluid as it travels through the narrower discharge end diameter. Notably, the diameters of the nozzles are inverse proportional to the speed of the drilling fluid, thus affecting the hydraulic performance and cleaning efficiency of the drill bit. The design, location and geometrical form of the nozzles play a significant role in minimizing the formation of cuttings bed in the wellbore, further enhancing the drilling process by maintaining the bit's cleanliness and reducing wear. The embodiment also covers the mean intake of the nozzles, located in the blade's manifold with a bigger diameter. The manifold serves as a conduit for directing drilling fluid to the nozzles. The varied diameter range of the intake facilitates regulation of the fluid flow to suit the specific drilling conditions. This particular feature has been conceived to ensure optimal operations irrespective of the drilling environment's complexity, thereby significantly enhancing the drilling bit's utility and overall functionality.

A method of drilling a hole in a subsurface formation is disclosed for the new drill bit. This process incorporates a bit body equipped with numerous radially extending blades. Between each adjacent pair of blades, there's a flow channel. Further along, the bit body includes a flow path that is located radially inward of its outer edges. This design allows for effective and efficient fluid flow, which is essential for successful drilling operations.

The method revolves around fixedly mounting multiple cutting elements on an individual blade from the extensive array of radially extending blades. These cutting elements are instrumental in breaking down the subsurface formations during the drilling process. Their strategic placement on the blades facilitates optimum drilling and provides superior control over the operation.

The blade's manifold provides the function of receiving the fluid flow from the bit body flow path, which is then channels through numerous conical profile's flow nozzles. Each of these nozzles serves a unique cutting element mounted on the subsequent neighboring blade. The fluid, thus, aids the cutting elements in their operation and expedites the drilling process. The strategic location of the port on the backside of the blades ensures it is perfectly aligned with the cutters on the emanating blade. This arrangement promotes the smooth flow of fluid, hence enhancing the overall drilling process. A plurality of flow nozzles are in fluid communication with the bit body flow path. These nozzles are vital as they direct the fluid to the blade's manifold. Eventually, the fluid is transferred to a specific cutting element.

A manifold is provided for each of the plurality of radially extending blades. The plurality of radially extending blades are evenly spaced along the circumference of a cylindrical or a drill head body parts. The interconnection of blades and manifolds provides a structured rigidity and aids the distribution of fluids (gases or liquids) or heat within the cylindrical or a drill head body part. The radially extending blades can of similar or dissimilar lengths and can extend from a center point outward in a radial direction, or along a linear path on the surface of the cylindrical or a drill head body parts, to distribute the fluids, heat or pressure in all radial directions.

The manifold is placed across or along the running length of each blade as a channel or a distribution medium. The manifold can be an open or a closed system of conduits, pipes or channels and can be made from materials that are heat resistant, chemically inert, or pressure resistant. The manifold carries and distributes fluids or heat from one point of the blade to all other points of the blade. The design of the manifold can vary based on the applications, the amount of fluid or heat to be carried, and the type and extent of distribution required. Indeed, the manifold may be segmented into multiple zones or sections, each with its own inlet and outlet system, for the directed control and distribution of fluids, heat or pressure.

By applying this method, it is possible to achieve a uniform distribution of fluids, heat, or pressure across the entire radial length of the blade. This is particularly beneficial in applications where even distribution across the entirety of the reactor vessel or cylinder is critical, such as in application in chemical or nuclear reacting systems, heat exchangers, pressure vessels, and other similar scenarios. The method increases the efficiency of these applications by allowing a better heat transfer or matter exchange between the blades and the internal environment of the vessel or the cylinder. Moreover, the manifolded blades can reduce the mechanical stress on the reactor vessel or the cylinder by evenly distributing the heat or pressure, thus increasing the lifespan and reliability of the system.

The method also involves the positioning and alignment of the fluid flow centerline within the specified angle. This positioning facilitates a more concentrated and focused output of high-pressure fluid towards the respective cutting element, resulting in a more efficient cutting operation with minimal resource wastage. The line that is formed passing through the central axis of the nozzle discharge port and the primary cutting surface edge heralds an innovative, direct and unobstructed pathway for the high-pressure fluid. This meticulous alignment furthermore mitigates the conventional challenges posed by uneven wear and tear as well as sub-optimal fluid delivery to the cutting element.

The above system can deliver the high-pressure fluid in a streamlined trajectory ensuring that the most optimal force is administered directly onto the cutting surface, thus augmenting the effectiveness and efficiency of the cutting process. In addition, this method paves the way for more sustainable operations by reducing fluid wastage and extending the lifespan of both the nozzles and the cutting elements. The innovatively orchestrated positioning and alignment system underlines the significance and potential of this design in revolutionizing cutting processes in a multitude of industrial applications. This increase in torque is accomplished by the strategic use of multiple hydrojets of drilling fluid, commonly known as mud. These hydrojets are instrumental in providing tangential momentum to the drill bit, thereby enhancing its operational efficiency. The hydrojets function on the principle of fluid mechanics, whereby the high-pressure drilling fluid is directed in a manner such that it generates a tangential force, effectively increasing the torque on the drill bit.

According to the devised method, the nozzles are judiciously located on the opposite side of the cutters, on the blades of the drill bit. This location fulfills dual roles. First, it allows for the effective dispersion of drilling fluids at maximum pressurized force, accentuating the cutting efficiency of the drill bit. Second, it helps in maintaining the stability of the drill bit, thereby reducing the possibilities of it veering off course during drilling operations. This positioning of the nozzles demonstrates an improved understanding of mechanical engineering principles and offers an innovative solution to augment drilling efficiency. The relative distance between the rotation center of the drill bit and the location of the hydrojet nozzles plays a critical role in torque enhancement, following the principles of torque calculation in physics. By placing the nozzles at a calculated radial distance from the drill bit's rotational center, a lever mechanism is created. This lever effect further amplifies the tangential force exerted by the hydrojets, intensifying the resultant torque on the drill bit. This design effectively integrates the principles of fluid dynamics, mechanics, and physics to bring an advancement in drilling technologies.

This design adjusts the common drilling practice by harnessing the hydro-motor capabilities of the drill bit. Typically, the drill bit and hole string are powered by the rig's engines, which consume significant amounts of power and produce notable environmental hazards such as air pollution and potentially oil spills. This design significantly reduces these issues by presenting a method that utilizes the hydro-motor features within the drill bit itself. This transformative approach contributes to energy efficiency while also reducing environmental impact.

Under standard conditions, the drill bit is connected to the hole string and both are rotated by the rig's engines. These engines are often bulky, require large amounts of fuel to operate, and can lead to significant environmental degradation. However, by employing the hydro-motor capabilities of the drill bit, this method transforms the present operating process, thereby both preserving resources and mitigating potential harmful effects on the environment. This method not only benefits the immediate drilling process, through reduced power consumption, but also contributes to broader sustainable practices in the drilling industry. If widely adopted, this innovative improvement could result in a substantial reduction in the drilling industry's carbon footprint. Furthermore, by decreasing reliance on large engine systems, the method also bears potential for reducing costs associated with engine maintenance, fuel consumption, and hazard control. By aligning technological feasibility with environmental responsibility, this system embodies a significant advancement in drilling practices.

The system maintains an optimal working temperature of the drilling bit. The design employs a novel technique to manage thermal loads by increasing the heat rejection from the head of the drill bit to the drilling mud by making the internal cooling channels in the drill bit head. The channels provide an efficient passage for heat dissipation that prolongs the life of the drill bit and enhances its performance, thus making the drilling process quicker and more cost-effective. The design of the drill bit head is a vital parameter in oil and gas drilling processes as it encounters extreme conditions, including exceedingly high temperatures and pressures. These conditions can degrade a bit faster, leading to costly replacements and reduced drilling pace. This system overcomes these challenges by incorporating specific cooling channels into the drill bit head. These channels are designed to facilitate efficient heat transfer from the drill bit head to the surrounding drilling mud. The cooling channels work in conjunction with the drilling mud to maintain the temperature of the drill bit head within a desired range, thus increasing the life and performance of the drill bit. The incorporation of the cooling channels into the drill bit head provides an innovative way of managing thermal loads during drilling processes. The strategy for increasing heat rejection from the PDC bit head, as well for Tricone drill bits, does not only help in preserving the cutting effectiveness of the bit but also contributes to the lowering of the overall temperature of the system, which has direct bearings on the rate of wear and tear of the other components of the drilling setup. This inventive method is of considerable significance for enhancing the operational efficiency and sustaining economic viability in oil and gas exploration and extraction processes.

Although specific embodiments of the invention have been described herein in some detail, this has been done solely for the purposes of explaining the various aspects of the invention and is not intended to limit the scope of the invention as defined in the claims which follow. Those skilled in the art will understand that the embodiments shown and described is exemplary, and various other substitutions, alterations and modifications, including but not limited to those design alternatives specifically discussed herein, may be made in the practice of the invention without departing from its scope.

What is claimed is:

1. A rotary drill bit for drilling a hole in a subsurface formation, comprising:

a bit body having a central bore for communicating hydraulic fluid;

a plurality of blades distributed circumferentially around a center axis;

at least one internal port having a longitudinal axis offset from a longitudinal centerline of the central bore;

an internal manifold located within at least one of the plurality of blades, the manifold being in fluid communication with the at least one internal port; and a plurality of flow nozzles coupled to the manifold and oriented to discharge high-speed fluid jets tangentially relative to the bit body profile toward a cutting edge of a cutting element on a rotationally trailing blade.

2. The rotary drill bit of claim 1, wherein the internal port comprises a curved geometry configured to minimize hydraulic pressure loss between the central bore and the manifold.

3. The rotary drill bit of claim 1, wherein each blade includes a flow channel defined between adjacent blades.

4. The rotary drill bit of claim 1, wherein each flow nozzle comprises a converging internal profile where an intake diameter is greater than a discharge diameter to increase the velocity of the fluid jets.

5. The rotary drill bit of claim 1, wherein each cutting element is constructed from polycrystalline diamond compact material.

6. The rotary drill bit of claim 1, wherein each blade is equally spaced apart from adjacent blades around the bit body.

7. The rotary drill bit of claim 1, wherein the internal port is fitted with a replaceable and interchangeable wear-resistant sleeve.

8. The rotary drill bit of claim 1, wherein the cutting elements comprise face cutting elements oriented perpendicular to the center axis and gauge cutting elements adjacent the peripheral edges.

9. The rotary drill bit of claim 1, wherein the internal manifold is provided for each of the plurality of blades.

10. The rotary drill bit of claim 1, wherein the flow nozzles are oriented at an acute angle relative to a trailing face of the blade to generate a forward rotational force.

11. The rotary drill bit of claim 1, comprising a metal sleeve to prevent internal erosion.

12. A method for drilling, comprising:

communicating a fluid from a central bore of a drill bit to a plurality of internal manifolds located within a respective plurality of blades, the drill bit including at least one internal port having a longitudinal axis offset from a longitudinal centerline of the central bore;

during drilling, directing the fluid through a plurality of flow nozzles to generate high-speed fluid jets; and discharging the fluid jets tangentially toward a cutting edge of a cutting element on a rotationally trailing blade to generate a forward rotational torque.

13. The method of claim 12, wherein the generation of forward rotational torque reduces the mechanical torque required from a drill string to rotate the bit.

14. The method of claim 12, wherein the flow nozzles are located on a trailing face of the blade to facilitate the tangential discharge.

15. A drill system, comprising:

a bit body having a central bore and a plurality of internal ports having axes offset from a centerline of the bore;

a network of coolant channels comprising primary channels and secondary channels;

wherein the primary channels are defined by fins in the central bore and extend parallel to the longitudinal axis and the secondary channels extend from the internal ports and branch toward the blades to provide heat rejection and increased bit rigidity.

16. The system of claim 15, wherein the secondary channels comprise flow nozzles that are located on a trailing face of their respective blade to facilitate a tangential discharge.

17. The system of claim 15, wherein the secondary channels comprise curved geometries to minimize fluid turbulence and internal erosion.

* * * * *